US010675895B2

(12) United States Patent
Lim et al.

(10) Patent No.: US 10,675,895 B2
(45) Date of Patent: Jun. 9, 2020

(54) TENSION APPLICATION DEVICE FOR PRINTER AND PRINTER HAVING THE SAME

(71) Applicant: BIXOLON CO., LTD., Seongnam-si, Gyeonggi-do (KR)

(72) Inventors: Geun Wha Lim, Suwon-si (KR); Gwang Keun Park, Suwon-si (KR)

(73) Assignee: BIXOLON CO., LTD., Seongnam-si (KR)

( * ) Notice: Subject to any disclaimer, the term of this patent is extended or adjusted under 35 U.S.C. 154(b) by 0 days.

(21) Appl. No.: 16/219,169

(22) Filed: Dec. 13, 2018

(65) Prior Publication Data

US 2019/0111713 A1 Apr. 18, 2019

Related U.S. Application Data

(63) Continuation of application No. 15/643,448, filed on Jul. 6, 2017, now Pat. No. 10,166,796.

(30) Foreign Application Priority Data

May 23, 2017 (KR) ..... 10-2017-0063510
May 23, 2017 (KR) ..... 10-2017-0063511

(51) Int. Cl.
*B41J 15/16* (2006.01)
*B65H 23/182* (2006.01)

(52) U.S. Cl.
CPC ..... *B41J 15/16* (2013.01); *B65H 23/1825* (2013.01); *B65H 2402/54* (2013.01); *B65H 2402/631* (2013.01); *B65H 2405/45* (2013.01); *B65H 2801/12* (2013.01)

(58) Field of Classification Search
CPC . B41J 15/04; B41J 15/042; B41J 15/16; B41J 29/02; B65H 23/085; B65H 2405/45; B65H 19/10; B65H 23/063; B65H 23/08; B65H 23/1955; B65H 23/1825; B65H 2402/54; B65H 2402/631; B65H 2801/12
See application file for complete search history.

(56) References Cited

U.S. PATENT DOCUMENTS

2011/0242245 A1 10/2011 Okazaki
2014/0192108 A1 7/2014 Horaguchi

*Primary Examiner* — Jannelle M Lebron
(74) *Attorney, Agent, or Firm* — Maschoff Brennan

(57) ABSTRACT

Provided is an unwinding device for unwinding a sheet from a sheet roll, the sheet roll being inserted onto the device. The unwinding device includes a shaft, a first rotating member and a second rotating member which are inserted onto the shaft, configured to be rotatable with rotation of the sheet roll, the sheet roll being inserted onto the first rotating member and the second rotating member, a first elastic member disposed between the first rotating member and the shaft, the first elastic member being configured to provide first back tension to the sheet when the first rotating member rotates, a second elastic member disposed between the second rotating member and the shaft, the second elastic member being configured to provide second back tension to the sheet when the second rotating member rotates, and a back tension controlling member disposed between the second elastic member and the shaft.

7 Claims, 26 Drawing Sheets

TENSION APPLICATION DEVICE FOR PRINTER AND PRINTER HAVING THE SAME

CROSS-REFERENCE TO RELATED APPLICATION

This application claims priority to and the benefit of Korean Patent Application Nos. 10-2017-0063510 and 10-2017-0063511, filed on May 23, 2017, the disclosure of which is incorporated herein by reference in its entirety.

BACKGROUND

1. Field of the Invention

The present invention relates to a tensioning device for a printer, an unwinding device for a printer, and a printer.

2. Discussion of Related Art

Printers are being used by people as means for transmitting information in their daily life. Printers refer to peripheral apparatuses that output information to be transmitted, on sheets. A user selects a type of printer to use considering a usage purpose, environments and the like.

Generally, a printer performs an output process while a sheet is transferred therein. Here, it is necessary to transfer the sheet to a predetermined place through a predetermined path at a predetermined speed to perform the output process with no errors and to prevent the printer from being out of order. Accordingly, devices for providing tension to the sheet are installed in the printer to transfer the sheet to the predetermined place through the predetermined path at the predetermined speed.

However, since existing devices for providing tension cannot provide adequate tension to the sheet, there is present a case in which the sheet is not transferred to the predetermined place through the predetermined path at the predetermined speed.

Due thereto, there is a limitation in which information to be transferred by the printer is not precisely output to the sheet. Also, there is a limitation in which the printer is out of order due to irregular movements of the sheet.

SUMMARY OF THE INVENTION

It is an aspect of the present invention to provide a tensioning device for a printer, capable of providing tension to a sheet to perform an output process of the printer with no errors by smoothly transferring the sheet in the printer, an unwinding device for a printer, and a printer.

Aspects of the present invention will not be limited to the above-described and others not set forth above will be definitely understood by one of ordinary skill in the art from the specification and the attached drawings.

One aspect of the present invention provides an unwinding device for unwinding a sheet from a sheet roll disposed in a printer, the sheet roll being inserted onto the device. The unwinding device includes a shaft, a first rotating member and a second rotating member which are inserted onto the shaft, configured to be rotatable with rotation of the sheet roll, the sheet roll being inserted onto the first rotating member and the second rotating member, a first elastic member disposed between the first rotating member and the shaft, the first elastic member being configured to provide first back tension to the sheet when the first rotating member rotates, a second elastic member disposed between the second rotating member and the shaft, the second elastic member being configured to provide second back tension to the sheet when the second rotating member rotates, and a back tension controlling member disposed between the second elastic member and the shaft, wherein the second back tension is not provided when the back tension controlling member is located in a first position, and wherein the second back tension is provided when the back tension controlling member is located in a second position.

The back tension controlling member is not interconnected with the shaft when the back tension controlling member is located in a first position, and wherein the back tension controlling member is interconnected with the shaft when the back tension controlling member is located in a second position.

The unwinding device may further include an interconnecting member fastened to the shaft, configured to control whether the back tension controlling member is interconnected with the shaft or not.

The back tension controlling member and an interconnecting member may each include a back tension connecting part and a back tension connected portion to provide the second back tension through mutual connection.

The back tension controlling member may further include a back tension contact part in contact with the second elastic member, the back tension contact part is rotatable in relation to the shaft, the back tension connecting part is formed to protrude from the back tension contact part, and the back tension connected portion is defined as a space into which the back tension connecting part is inserted.

An interconnecting member may include a dividing part that divides the connected portion, and the back tension connecting part may be formed to be larger than the back tension connecting part to reduce interference between the back tension connecting part and the dividing part when the back tension connecting part is inserted into the connected portion.

The back tension connecting part may be inserted into the connected portion by a change of the second rotating member in position based on the first rotating member.

The second rotating member may be connected with the first rotating member regardless of the change of the second rotating member in position based on the first rotating member.

The back tension connecting part may be inserted into the back tension connected portion by a withdrawal of the second rotating member based on the first rotating member.

The unwinding device may further include a deviation preventing member connected to the second rotating member, the deviation preventing member being configured to prevent the back tension controlling member from deviating from the second rotating member.

A change of the back tension controlling member in position may be performed by a change of the second rotating member in position based on the first rotating member.

The change of the back tension controlling member in position may be performed by a withdrawal of the second rotating member based on the first rotating member while the second rotating member is connected to the first rotating member.

Another aspect of the present invention provides an unwinding device for unwinding a sheet from a sheet roll disposed in a printer, the sheet roll being inserted onto the device. The unwinding device includes a shaft, a first rotating member and a second rotating member which are inserted onto the shaft, configured to be rotatable with rotation of the sheet roll, the sheet roll being inserted onto the first rotating member and the second rotating member, a first elastic member disposed between the first rotating member and the shaft, the first elastic member being configured to provide first back tension to the sheet when the first rotating member rotates, a second elastic member disposed between the second rotating member and the shaft, the second elastic member being configured to provide second back tension to the sheet when the second rotating member rotates. Here, the second rotating member controls whether the second elastic member provides the second back tension to the sheet by changing a position in relation to the first rotating member.

Still another aspect of the present invention provides an unwinding device for unwinding a sheet from a sheet roll disposed in a printer, the sheet roll being inserted onto the device. The unwinding device includes a shaft, a first rotating member and a second rotating member which are inserted onto the shaft, configured to be rotatable with rotation of the sheet roll, the sheet roll being inserted onto the first rotating member and the second rotating member, a first elastic member disposed between the first rotating member and the shaft, the first elastic member being configured to provide first back tension to the sheet when the first rotating member rotates, a second elastic member disposed between the second rotating member and the shaft, the second elastic member being configured to provide second back tension to the sheet when the second rotating member rotates. Here, the second elastic member controls whether to provide the second back tension to the sheet by changing a position in relation to the shaft.

Yet another aspect of the present invention provides a printer including an unwinding device configured to unwind a sheet from a sheet roll and a printing unit configured to print an information on the sheet provided from the unwinding device, wherein the unwinding device comprises a shaft, a first rotating member and a second rotating member into which the shaft is inserted, configured to be rotatable with rotation of the sheet roll, the sheet roll being inserted onto the first rotating member and the second rotating member, a first elastic member disposed between the first rotating member and the shaft, the first elastic member being configured to provide first back tension to the sheet when the first rotating member rotates, a second elastic member disposed between the second rotating member and the shaft, the second elastic member being configured to provide second back tension to the sheet when the second rotating member rotates and a back tension controlling member disposed between the second elastic member and the shaft, wherein the second back tension is not provided when the back tension controlling member is located in a first position, and wherein the second back tension is provided when the back tension controlling member is located in a second position, wherein the unwound sheet is provided to the printing unit.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
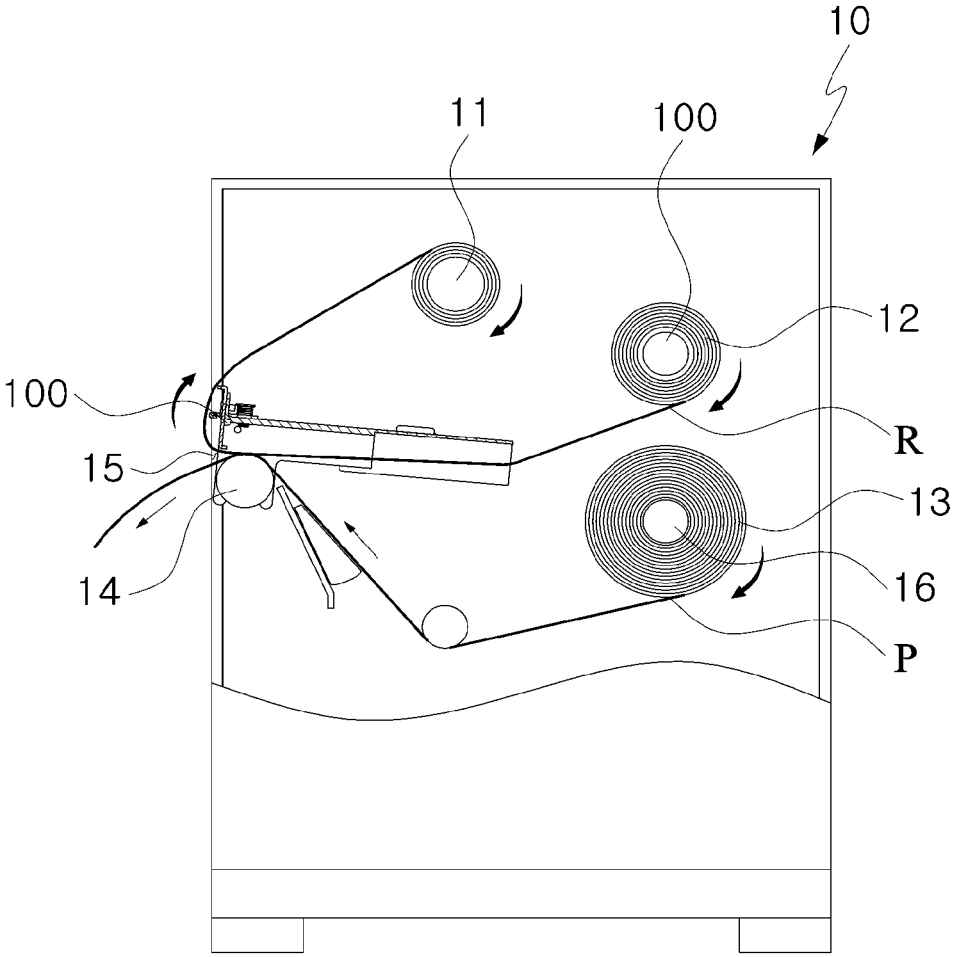
FIG. 1 is a cross-sectional view of a printer according to one embodiment of the present invention.

Hereinafter, detailed embodiments of the present invention will be described in detail with reference to the drawings. However, the concept of the present invention is not limited to the disclosed embodiments and those skilled in the art who understand the concept of the present invention may easily provide other embodiments included within the scope of the concept of the present invention or other retrogressive inventions through addition, change, deletion and the like of other components without departing from the scope of the same concept, which are also be included within the scope of the present invention.

Also, throughout the drawings of the embodiments, like elements having the same function within the scope of the same concept will be referred to as like reference numerals.

Throughout the specification, when it is determined that a detailed description of a well-known related configuration or function obscures the understanding of the embodiments of the present invention, the detailed description thereof will be omitted.

A printer may include all apparatuses capable of outputting information to be transmitted, on a sheet. For example, the printer may be one of a ribbon printer, a thermal printer, a label printer, an inkjet printer, a laser printer, a dot-matrix printer and the like.

Hereinafter, the printer will be described based on a dye sublimation printer using ribbons but is not limited thereto.

Also, since a following drawn-up list is for easily describing the features of the present invention, a feature described in one item of the list is not limited to the one item but may be applied to other items.

1. Printer

FIG. 1 is a cross-sectional view of a printer according to one embodiment of the present invention.

Referring to FIG. 1, a printer 10 according to one embodiment of the present invention may include a paper device 16 onto which a paper roll 13 which is a paper P wound in a roll shape is inserted, an unwinding device 100 for a printer onto which a ribbon roll 12 which is a ribbon R wound in a roll shape, a flattening roller 14 that transfers the ribbon R unwound from the unwinding device 100 and the paper P unwound from the paper device 16, a winding device 11 on which the ribbon R transferred by the flattening roller 14 is wound, a discharging portion 15 through which the paper P transferred by the flattening roller 14 is discharged, a printer head (not shown) disposed above the flattening roller 14 to perform a process of outputting the paper P and the ribbon R transferred by the flattening roller 14 and a tensioning device 200 for a printer, which provides tension to the ribbon R that is output. The printer 10 may include a printing device that performs printing using a sheet wound from a sheet roll that may include the paper roll 13 and/or the ribbon roll 12.

Here, the printing device may refer to a configuration that performs printing in the printer 10.

For example, the printing device may include the flattening roller 14, the printer head, and the like.

A sheet that will be described below may include all media used for outputting information from a printer.

For example, the sheet may be one of general label paper, linerless label, general thermal paper not coated with an adhesive, and the like, may be ribbon, or may be one of fabric, plastic, and the like.

Here, the ribbon may be a printing product with one side on which an ink layer formed by mixing synthetic dyes is formed.

Also, the sheet may be stored in a roll shape as shown in FIG. 1 or may be stored in a shape formed by folding with a certain pattern called fanfold.

Also, the sheet may be continuous form paper, cut-sheet paper, or partially connected paper of cut-sheet paper.

However, the sheet is not limited to the above-described example and may include all products used for printing in general industrial settings.

Hereinafter, the unwinding device 100 and the tensioning device 200 provided at the printer 10 will be described in detail.

Here, since the above-described paper device 16, the flattening roller 14, the winding device 11, the discharging portion 15, the printer head, and other components in relation to the printer 10 are well-known technologies, a detailed description thereof will be omitted.

2. Unwinding Device for Printer

Hereinafter, a sheet will be described based on ribbon in a roll shape but not intended to limit the use of the present invention.

Figure 2:
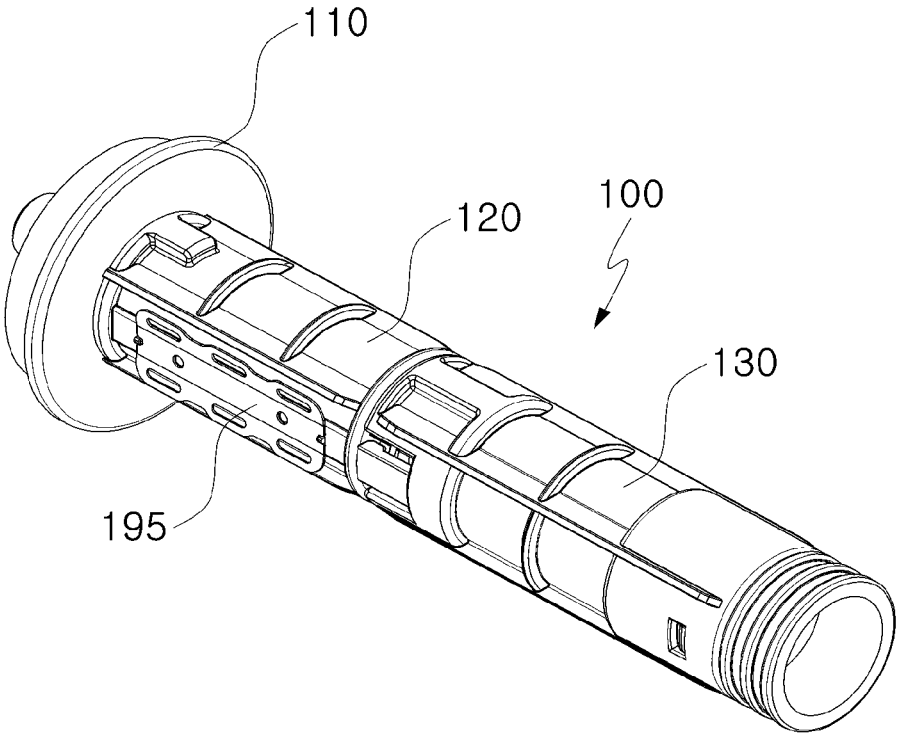
FIG. 2 is a combination perspective view of an unwinding device for a printer, which is provided at the printer according to one embodiment of the present invention.

FIG. 2 is a combination perspective view of the unwinding device for a printer, which is provided at the printer according to one embodiment of the present invention.

Referring to FIG. 2, as the unwinding device 100 onto which the ribbon roll 12 is inserted may be rotated with the ribbon roll 12 which is rotated by the flattening roller 12 and/or the winding device 11, the unwinding device 100 may provide back tension to a ribbon R (refer to FIG. 1) while the ribbon R is unwound from the ribbon roll 12. The unwinding device 100 may include a supporting member 110 connected to a body of the printer 10, a first rotating member 120 connected to the supporting member 110, and a second rotating member 130 connected to the first rotating member 120 Here, the ribbon roll 12 is inserted onto the first rotating member 120 and the second rotating member 120, configured to provide back tension to ribbon R unwound from the ribbon roll R.

In the unwinding device 100, both the first rotating member 120 and the second rotating member 130 may provide back tension to the ribbon R while being rotated with the ribbon roll 12.

Also, in the unwinding device 100, only the first rotating member 120 may provide back tension to the ribbon R while the first rotating member 120 and the second rotating member 130 are rotated with the ribbon roll 12.

Hereinafter, a principle in which the first rotating member 120 and the second rotating member 130 provide back tension to the ribbon R will be described in detail.

Figure 3:
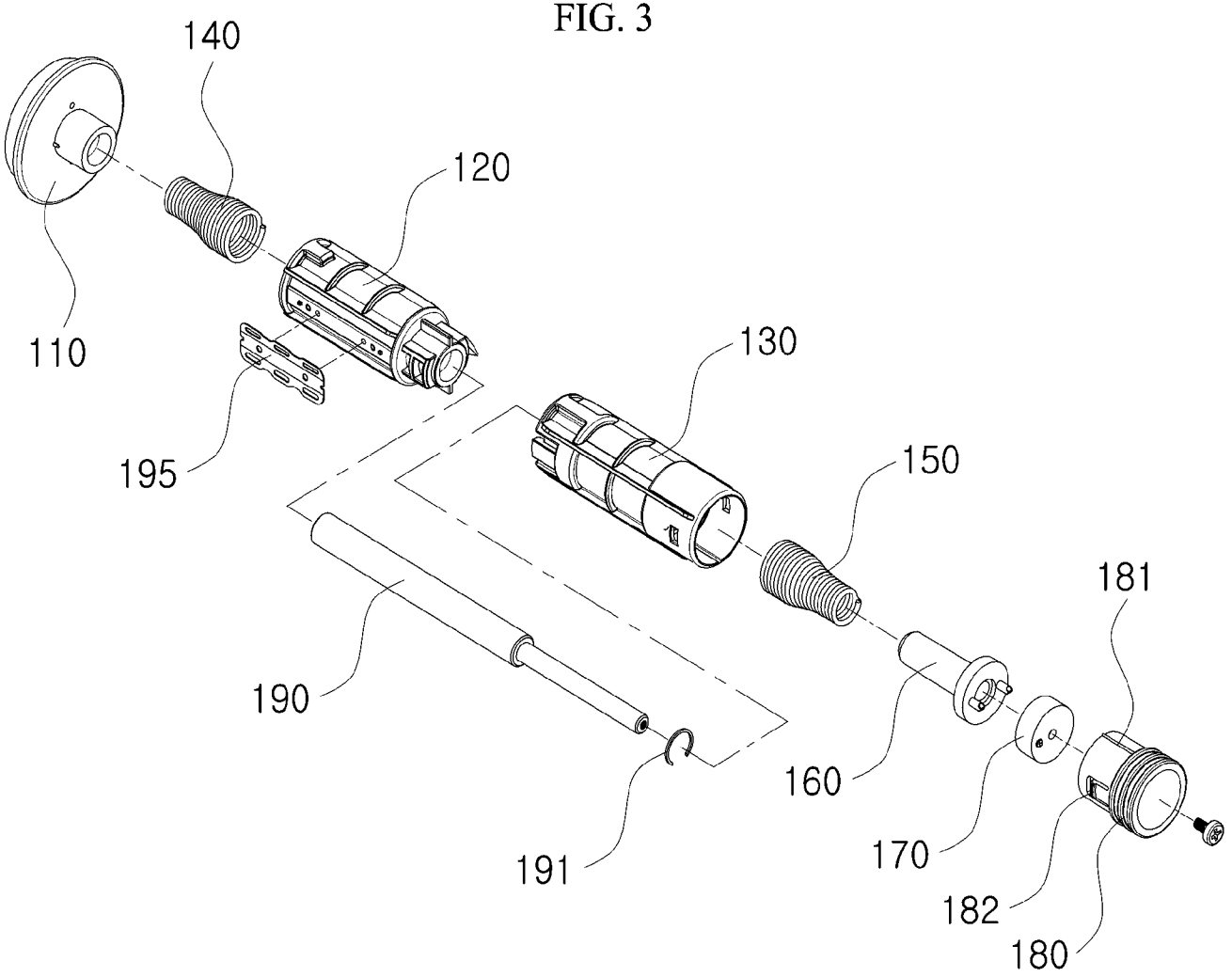
FIG. 3 is an exploded perspective view of the unwinding device for a printer, which is provided at the printer according to one embodiment of the present invention.

FIG. 3 is an exploded perspective view of the unwinding device for a printer, which is provided at the printer according to one embodiment of the present invention.

Hereinafter, the ribbon roll 12 that has been described with reference to FIG. 2 is changed into a sheet roll.

Referring to FIG. 3, the unwinding device 100 according to one embodiment of the present invention is a device onto which a sheet roll is inserted to unwind a sheet from the sheet roll and may include a shaft 190, the first rotating member 120 and the second rotating member 130 which are inserted onto the shaft 190 configured to be rotatable with rotation of the sheet roll, the sheet roll being inserted onto the first rotating member 120 and the second rotating member 130, a first elastic member 140 disposed between the first rotating member 120 and the shaft 190 to provide first back tension to the sheet when the first rotating member 120 rotates, a second elastic member 150 disposed between the second rotating member 130 and the shaft 190 to provide second back tension to the sheet when the second rotating member 130 rotates, and a back tension controlling member 160 disposed between the second elastic member 150 and the shaft 190, controlling whether to the second elastic member 150 provides the second back tension to the sheet or not by changing a position in relation to the shaft 190.

The unwinding device 100 according to one embodiment of the present invention may further include an interconnecting member 170 fastened to the shaft 190 to control whether to connect the back tension controlling member 160 to the shaft 190 and a deviation preventing member 180 fastened to the second rotating member 130 to prevent the back tension controlling member 160 from being deviated from the second rotating member 130.

In other words, the second back tension is not provided when the back tension controlling member 160 is located in a first position and the second back tension is provided when the back tension controlling member 160 is located in a second position.

Figure 4:
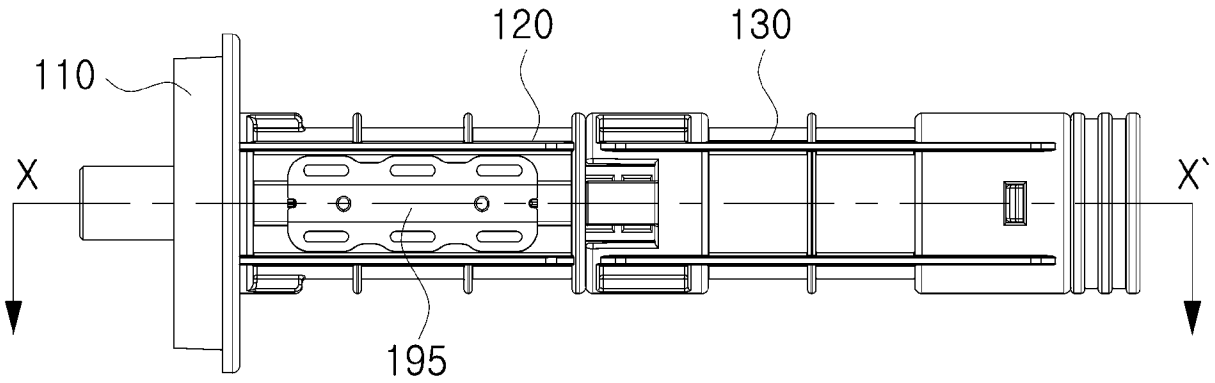
FIGS. 4 and 5 are views illustrating an operation of the unwinding device for a printer, which is provided at the printer according to one embodiment of the present invention.
Figure 5:
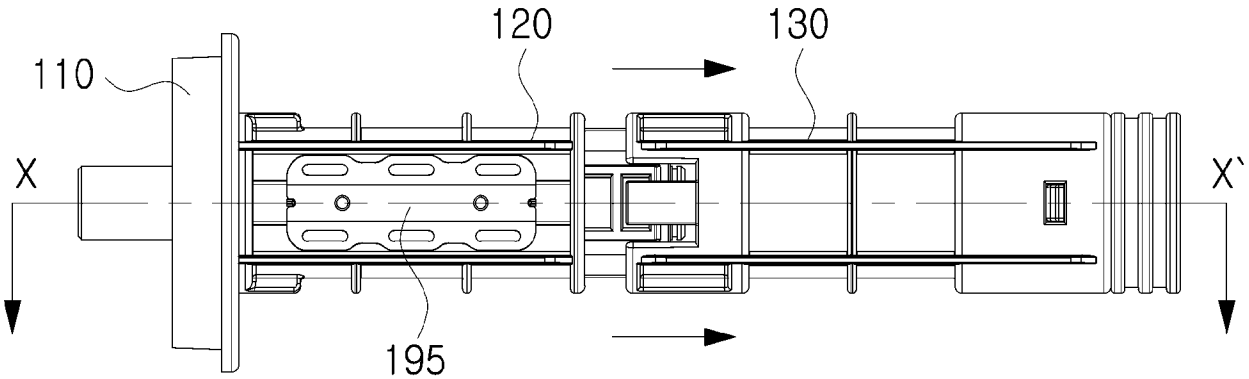

Here, first position is drawn in FIG. 4 and second position is drawn in FIG. 5.

Also, the back tension controlling member 160 is not interconnected with the shaft 190 when the back tension controlling member 160 is located in a first position and the back tension controlling member 160 is interconnected with the shaft 190 when the back tension controlling member 160 is located in a second position.

Also, the interconnecting member 170 fastened to the shaft 190, configured to control whether the back tension controlling member 160 is interconnected with the shaft or not.

The unwinding device 100 may further include a fixing member 195 that fixes the sheet roll to the first rotating member 120 and/or the second rotating member 130.

Although the fixing member 195 is shown as being coupled only with the first rotating member 120 in FIG. 3, the fixing member 195 is not limited thereto and may be coupled only with the second rotating member 130 or may be coupled with both the first rotating member 120 and the second rotating member 130.

The first rotating member 120 may be connected to the supporting member 110 rotatably connected to the body of the printer 10.

The supporting member 110 may assist the first rotating member 120 and the second rotating member 130 in stable rotation thereof.

Here, the supporting member 110 may be connected to the body of the printer 10 to prevent a movement in position in one direction.

That is, the supporting member 110 may move in position in a direction from the first rotating member 120 to the second rotating member 130 but may be connected to the body of the printer 10 to limit a movement in position in a direction from the first rotating member 120 to the body of the printer 10.

However, the supporting member 110 may be limited in moving in position in a direction from the first rotating member 120 to the second rotating member 130 by a movement preventing member 191.

The first elastic member 140 may be inserted into the first rotating member 120.

The shaft 190 may be inserted into the first elastic member 140 and then, the shaft 190 and the elastic member 140 may be inserted into the first rotating member 120.

In detail, the first elastic member 140 may be positioned in the first rotating member 120 and the shaft 190 may be positioned in the first elastic member 140.

The second elastic member 150 may be inserted into the second rotating member 130, the back tension controlling member 160 may be inserted into the second elastic member 150 inserted in the second rotating member 130, and the back tension controlling member 160 may be inserted onto the shaft 190

In detail, the second elastic member 150 may be positioned in the second rotating member 130, the back tension controlling member 160 may be arranged in the second elastic member 150, and the shaft 190 may be positioned in the back tension controlling member 160.

The first elastic member 140 may be disposed between the first rotating member 120 that rotates and the shaft 190 that does not rotate.

The first elastic member 140 may provide an elastic force to the first rotating member 120 in a direction opposite to a rotational direction of the first rotating member 120 when the first rotating member 120 is rotated in such a way that the first rotating member 120 may provide the first back tension to the sheet.

However, the second elastic member 150 may selectively provide the second back tension to the sheet when the second rotating member 130 is rotated.

It may be performed by the back tension controlling member 160, an interconnecting member 170, and the deviation preventing member 180 arranged in the second rotating member 130 whether the second back tension is selectively provided and will be described below.

The first elastic member 140 and the second elastic member 150 may be coil springs that are inserted into the shaft 190.

The shaft 190 may include the movement preventing member 191 that limits a movement of the first rotating member 120 in position caused by a movement of the back tension controlling member 160 in position.

The movement preventing member 191 may be mounted on a groove formed in the shaft 190 and connected to the shaft 190.

Figure 6:
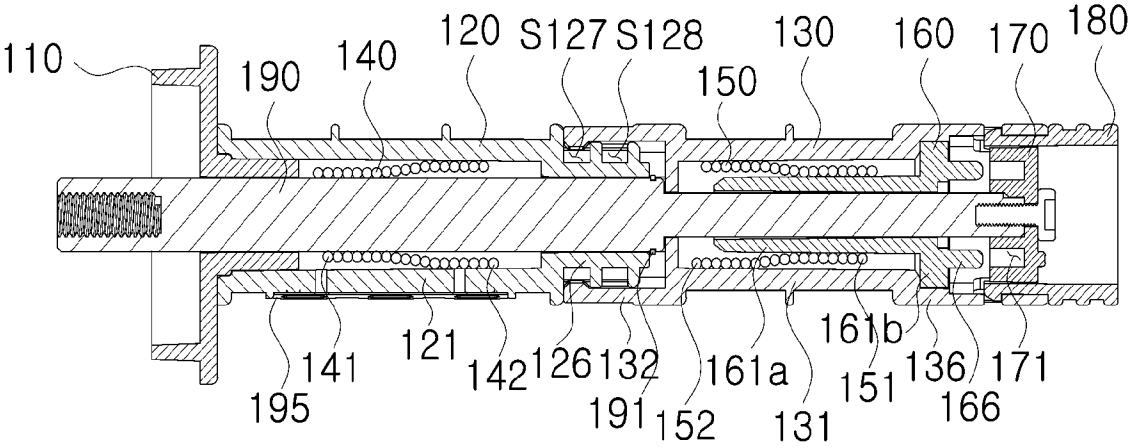
FIGS. 6 and 7 are cross-sectional views illustrating a part taken along line X-X' shown in FIGS. 4 and 5.
Figure 7:
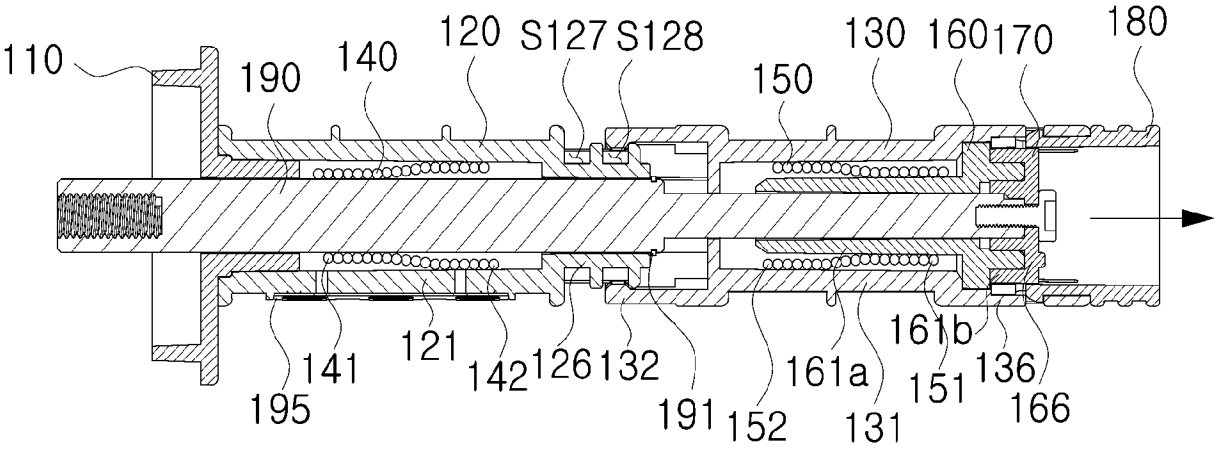

FIGS. 4 and 5 are views illustrating an operation of the unwinding device for a printer, which is provided at the printer according to one embodiment of the present invention, and FIGS. 6 and 7 are cross-sectional views illustrating a part taken along line X-X' of FIGS. 4 and 5.

FIGS. 8 to 13 are views illustrating components included by the unwinding device according to one embodiment of the present invention.

Figure 8:
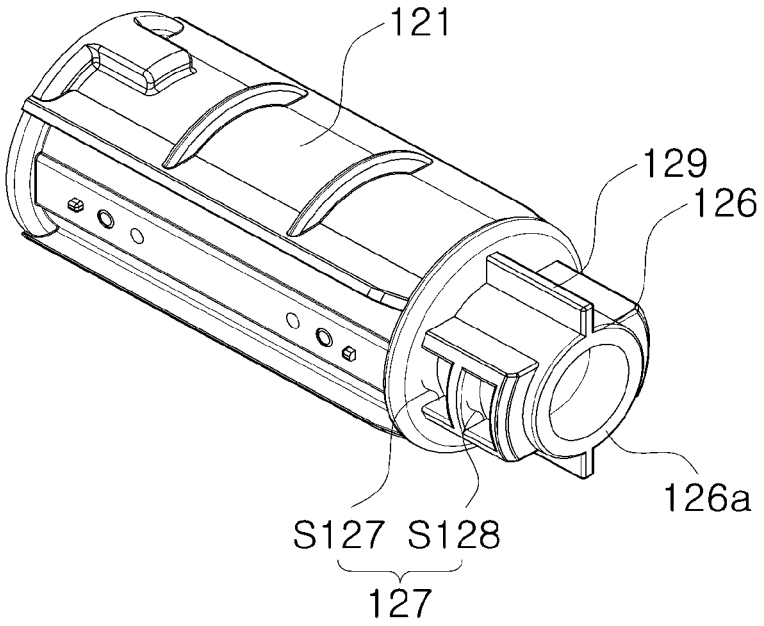
FIGS. 8 and 9 are perspective views of a first rotating member provided at the unwinding device for a printer according to one embodiment of the present invention.
Figure 9:
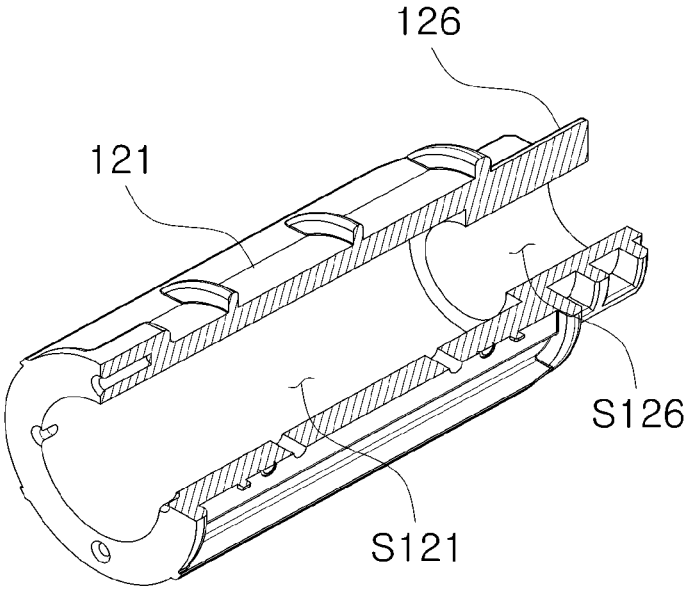
Figure 10:
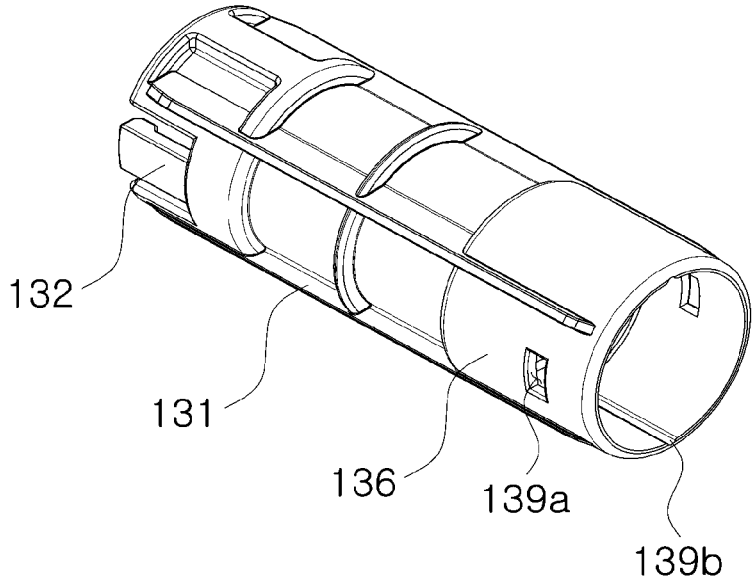
FIGS. 10 and 11 are perspective views of a second rotating member provided at the unwinding device for a printer according to one embodiment of the present invention.
Figure 11:
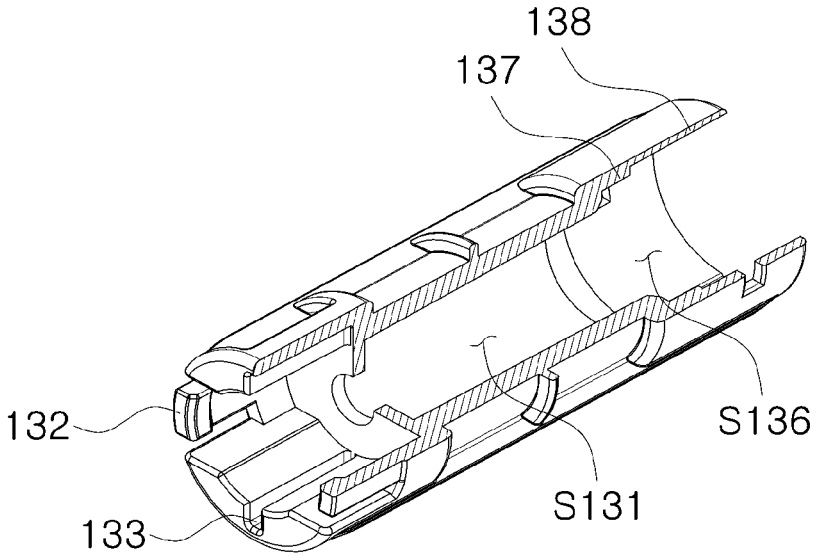
Figure 12:
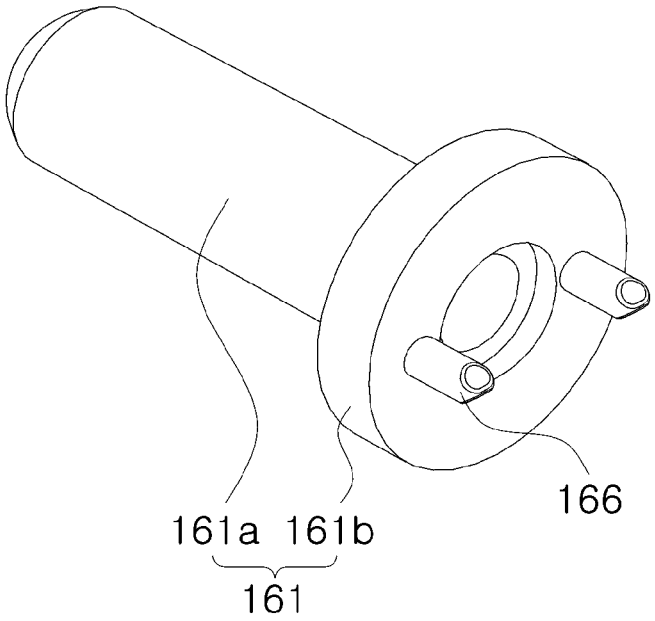
FIG. 12 is a perspective view of a back-tension controlling member provided at the unwinding device for a printer according to one embodiment of the present invention.
Figure 13:
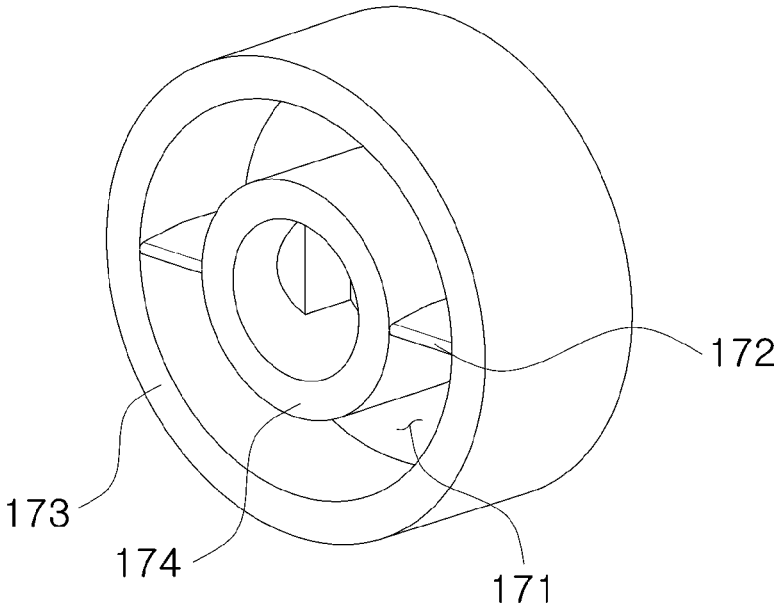
FIG. 13 is a perspective view of an interconnecting member provided at the unwinding device for a printer according to one embodiment of the present invention.

FIGS. 8 and 9 are perspective views of the first rotating member provided at the unwinding device according to one embodiment of the present invention, FIGS. 10 and 11 are perspective views of the second rotating member provided at the unwinding device according to one embodiment of the present invention, FIG. 12 is a perspective view of the back-tension controller provided at the unwinding device according to one embodiment of the present invention, FIG. 13 is a perspective view of an interconnecting member provided at the unwinding device according to one embodiment of the present invention.

Referring to FIGS. 4 and 5, the unwinding device 100 may control whether to provide the second back tension through the second elastic member 150 by changing in position.

That is, in the unwinding device 100, the second rotating member 130 is changed in position based on the first rotating member 120 in such a way that it may be controlled whether to provide the second back tension through the second elastic member 150.

FIG. 4 is a view illustrating a state in which the second back tension is not provided, and FIG. 5 is a view illustrating a state in which the second back tension is provided with the first back tension.

In the state shown in FIG. 4, the second rotating member 130 is moved in position in a longitudinal direction based on the first rotating member 120 and may come into the state shown in FIG. 5.

When the state shown in FIG. 4 is changed into the state shown in FIG. 5, the back tension controlling member 160 (refer to FIGS. 6 and 7) may also be changed in position.

The change of the back tension controlling member 160 in position may be performed by withdrawing of the second rotating member 130 based on the first rotating member 120 while the second rotating member 130 is connected to the first rotating member 120.

As the position of the second rotating member 130 is changed, the second elastic member 150 and the back tension controlling member 160 may also be changed in position based on the shaft 190 (refer to FIGS. 6 and 7).

It is controlled through a series of processes whether to provide the second back tension.

Accordingly, since a user may adjust back tension by considering a use environment, an operation state, and the like through control, a printing operation may be more effectively performed.

In one embodiment of the present invention, it has been described that the second elastic member 150 (refer to FIGS. 6 and 7) and the back tension controlling member 160 are moved in position corresponding to the change of the second rotating member 130 in position. However, not limited thereto, at a degree obvious to those skilled in the art, components and/or combinations thereof may be changed in one embodiment of the present invention to allow the second elastic member 150 and/or the back tension controlling member 160 to change in position regardless of the change of the second rotating member 130 in position to control whether to provide the second back tension.

Hereinafter, combination relationships among components will be described in detail.

Referring to FIGS. 6 to 7, the first rotating member 120 may include a first rotational body 121 that forms an exterior and a first rotational protrusion 126 formed to protrude from the first rotational body 121 in a longitudinal direction.

Here, the first rotational body 121 may define a first rotational space S121 that is an internal space.

The first rotational protrusion 126 may define a second rotational space S126 that is an internal space.

Also, the first elastic member 140 which is inserted onto the shaft 190 may be disposed in the first rotational space S121, and for this, the first rotational space S121 may be larger than the second rotational space S126.

Also, the first rotational protrusion 126 formed to protrude from the first rotational body 121 may be inserted into the second rotating member 130.

Here, the first rotational protrusion 126 may include a connection maintaining part 127 that prevents the second rotating member 130 from being deviated from the first rotating member 120 while being connected to the first rotating member 120 and a guide part 129 that protrudes from the first rotational protrusion 126 to guide a withdrawal of the second rotating member 130.

Here, the connection maintaining part 127 may include a first fastening space S127 and a second fastening space S128.

When a position determining part 132 (refer to FIGS. 10 and 11) of the second rotating member 130 is disposed in the first fastening space S127, only the first back tension may be provided to the sheet.

When the position determining part 132 is disposed in the second fastening space S128, the first back tension and the second back tension may be provided to the sheet.

Also, the guide part 129 may be formed to protrude from the first rotational protrusion 126 but is not limited thereto and may be formed to be depressed.

Also, the connection maintaining part 127 and/or the guide part 129 are shown as being formed at the first rotational protrusion 126 to be symmetrical but are not limited thereto and may be formed at the first rotational protrusion 126 to be asymmetrical.

Also, the first rotational protrusion 126 may include a shaft contact part **126*a* in contact with the movement preventing member 191 of the shaft 190**.

The shaft contact part **126*a* may come into contact with the movement preventing member 191 and may prevent the first rotating member 120 and the supporting member 110** from being moved in position.

In detail, the shaft 190 may be fixed to the body of the printer 10.

Also, the supporting member 110 and the first rotating member 120 may be disposed between the body of the printer 10 and the movement preventing member 191.

Since the shaft contact part **126*a* is held by the movement preventing member 191, the supporting member 110 and the first rotating member 120 may be limited in being moved in position in a direction from the first rotating member 120 to the second rotating member 130**.

Also, the shaft contact part **126*a* may come into contact with the movement preventing member 191 and may prevent the first rotating member 120 and the supporting member 110 from being moved in position during a process in which the second rotating member 130** is moved in position.

In detail, a connection between the first rotating member 120 and the second rotating member 130 may be performed by fastening between the connection maintaining part 127 and the position determining part 132 of the second rotating member 130, which will be described below.

When the second rotating member 130 is withdrawn based on the first rotating member 120 while the second rotating member 130 is connected to the first rotating member 120, an external force may be applied to the connection maintaining part 127 by moving the position determining part 132 in position.

However, since the movement preventing member 191 comes into contact with the shaft contact part **126*a* in such a way that the supporting member 110 and/or the first rotating member 120 are limited in moving in position, the first rotating member 120 and/or the supporting member 110 may be prevented from being moved in position in a direction from the first rotating member 120 to the second rotating member 130** by the external force.

Here, to perform the above-described function, the movement preventing member 191 may have a width (that may be a diameter in one embodiment of the present invention) greater than that of the second rotational space S126.

Also, the first elastic member 140 may be disposed in the first rotational space S121 defined by the first rotational body 121.

Here, the first elastic member 140 may include a first elastic member one end 141 that is one end and a first elastic member other end 142 that is the other end.

Also, the first elastic member 140 is disposed in the first rotational space S121 in such a way that an inner surface of the first elastic member one end 141 may come into contact with the shaft 190 and an outer surface of the first elastic member other end 142 may come into an inner surface of the first rotating member 120.

Referring to FIGS. 6, 7, 10, and 11, the second rotating member 130 may include a second rotational body 131 that forms an exterior, a second rotational protrusion 136 formed to protrude from the second rotational body 131 in a longitudinal direction, and a position determining part 132 and a guided portion 133 formed to protrude from the second rotational body 131 in a longitudinal direction opposite to the second rotational protrusion 136.

Here, the first rotational protrusion 126 of the first rotating member 120 may be inserted into a space defined by the position determining part 132 and the guided portion 133.

In more detail, the guide part 129 of the first rotational protrusion 126 may be inserted into the guided portion 133 and the position determining part 132 of the second rotating member 130 may be connected to the connection maintaining part 127.

Here, since the guide part 129 is connected to the guided portion 133, when the second rotating member 130 is moved in position based on the first rotating member 120, the guide part 129 slides from the guided portion 133 in such a way that the second rotating member 130 may be moved in position.

Also, since the position determining part 132 is inserted into the first fastening space S127 or the second fastening space S128 of the connection maintaining part 127, the second rotating member 130 may remain in the changed position.

Here, the guided portion 133 and/or the position determining part 132 are shown as being formed to be symmetrical based on the second rotational body 131 but are not limited thereto and may be formed to be asymmetrical based on the second rotational body 131.

Here, the second rotational body 131 may define a third rotational space S131 that is an internal space and the second rotational protrusion 136 may define a fourth rotational space S136 that is an internal space.

Here, the back tension controlling member 160 and the second elastic member 150 which is inserted onto the shaft 190 may be arranged in the third rotational space S131 and the back tension controlling member 160, an interconnecting member 170, and the deviation preventing member 180 may be arranged in the fourth rotational space S136.

To describe the back tension controlling member 160 inserted in the second rotating member 130, referring to FIG. 12, the back tension controlling member 160 may include a back tension contact part 161 and a back tension connecting part 166.

The back tension contact part 161 may include a small diameter part 161*a* inserted into the second elastic member 150 to come into contact therewith and a large diameter part 161*b* in contact with an inner surface of the second rotational protrusion 136.

Here, the small diameter part 161*a* and the large diameter part 161*b* may be rotatable around the shaft 190.

The back tension connecting part 166 may be formed to protrude from the back tension contact part 161 to allow the second back tension to be provided through connection with an interconnecting member 170.

To describe an interconnecting member 170 inserted into the second rotating member 130, referring to FIGS. 6, 7, and 13, an interconnecting member 170 may include a back tension connected portion 171 defined as a connected space, an outer surface part 173 and an inner surface part 174 that define the back tension connected portion 171, and a dividing part 172 that divides the back tension connected portion 171.

Here, the outer surface part 173 may form an exterior of an interconnecting member 170.

The inner surface part 174 may be formed in the outer surface part 173 in a circumferential direction from the outer surface part 173.

The back tension connected portion 171 may be defined in a space between the outer surface part 173 and the inner surface part 174.

However, it is not limited thereto and may be variously changed at a degree obvious to those skilled in the art.

Here, since the back tension connected portion 171 is formed to be larger than the back tension connecting part 166 (refer to FIG. 12), when the back tension connecting part 166 is inserted into the back tension connected portion 171, an interference between the back tension connecting part 166 and the dividing part 172 may be reduced.

In more detail, since the back tension connecting part 166 is formed to be smaller than the back tension connected portion 171, the back tension connecting part 166 may be easily inserted into the back tension connected portion 171 regardless of an angle at which the back tension controlling member 160 is positioned.

The shaft 190, the small diameter part 161*a* of the back tension controlling member 160, and the second elastic member 150 may be sequentially arranged in a circumferential direction from a central shaft of the second rotating member 130 in the third rotational space S131 defined by the second rotational body 131.

In more detail, the second elastic member 150 may include a second elastic member one end 151 that is one end and a second elastic member other end 152 that is the other end.

The second elastic member 150 may be disposed on an inner surface of the second rotating member 130 in such a way that an inner surface of the second elastic member one end 151 comes into the small diameter part 161*a* of the back tension controlling member 160 and an outer surface of the second elastic member other end 152 comes into the inner surface of the second rotating member 130.

The large diameter part 161*b* of the back tension controlling member 160, an interconnecting member 170, and the deviation preventing member 180 may be arranged in the fourth rotational space S136 defined by the second rotational protrusion 136.

In more detail, the second rotational protrusion 136 may include a first surface 137 that comes into the large diameter part 161*b* and defines the fourth rotational space S136 and a second surface 138 into which the deviation preventing member 180 is inserted to come in contact therewith and defines the fourth rotational space S136.

Here, a diameter of a space defined by the first surface 137 may be smaller than a diameter defined by the second surface 138.

However, not limited thereto, when the second rotational protrusion 136 has another shape instead of a circular shape, a width of the space defined by the first surface 137 may be smaller than a width of a space defined by the second surface 138.

The deviation preventing member 180 may be inserted into the second rotating member 130 and then fixed to the second rotating member 130 because a first coupling part 182 (refer to FIG. 3) of the deviation preventing member 180 is inserted into a first insertion portion 139*a* (refer to FIG. 10) formed at the second rotational protrusion 136.

Here, to allow the first coupling part 182 to be easily inserted into the first insertion portion 139*a*, a first protrusion 181 (refer to FIG. 3) that may be formed to protrude from the deviation preventing member 180 and a second insertion portion 139*b* (refer to FIG. 10) corresponding to the first protrusion 181 may be formed at the second surface 138.

Also, one surface of the deviation preventing member 180 may come into one surface of the large diameter part 161*b*.

Also, the one surface of the deviation preventing member 180 may come into contact with an end formed by the first surface 137 and the second surface 138.

Accordingly, the large diameter part 161*b* may be limited in moving in a direction from the second rotational protrusion 136 to the second rotational body 131 due to a step formed by the second rotational body 131 and the second rotational protrusion 136.

Also, the large diameter part 161*b* may be limited in moving in a direction from the second rotational body 131 to the second rotational protrusion 136 due to contact with the deviation preventing member 180.

Also, an interconnecting member 170 may be connected to the shaft 190 and may be inserted into the deviation preventing member 180.

Here, the shaft 190 may be inserted into a space defined by the inner surface part 174 of an interconnecting member 170 and the shaft 190 and an interconnecting member 170 may be coupled with each other by a screw that passes through an interconnecting member 170.

Hereinafter, an operation process of the unwinding device 100 will be described in detail.

First, a state, shown in FIG. 6, in which the second rotating member 130 is not withdrawn based on the first rotating member 120 will be described.

Here, the second rotating member 130 may be connected to the first rotating member 120 to dispose the position determining part 132 of the second rotating member 130 in the first fastening space S127.

Also, the back tension connecting part 166 may be disposed to be spaced apart from the back tension connected portion 171.

Accordingly, since the back tension connecting part 166 may be disposed to be spaced apart from the back tension connected portion 171, the back tension controlling member 160 may be disposed at the shaft 190 to be rotatable.

When the sheet roll is rotated clockwise by external power of the winder and/or the flattening roller, the first rotating member 120 may be rotated clockwise by the fixing member 195. When the first rotating member 120 is rotated, the first elastic member other end 142 in contact with the inner surface of the first rotating member 120 may also be rotated clockwise.

Here, due to a first force of the first elastic member other end 142 to the first rotating member 120, the first elastic member other end 142 may also be rotated when the first rotating member 120 is rotated.

Here, the first force may be a force by which the first elastic member other end 142 can be fixed to the inner surface of the first rotating member 120.

The first force may be generated by a frictional force between the first elastic member other end 142 and the first rotating member 120 or may be generated by an elastic force of the first elastic member other end 142.

Also, as the first elastic member other end 142 is rotated, the first elastic member 140 may be expanded.

Here, since the first elastic member 140 is expanded, the first elastic member other end 142 of the first elastic member 140 transfers a force to the first rotating member 120 counterclockwise to provide the first back tension to the sheet.

Here, from a first time point that the first rotating member 120 starts being rotated clockwise to a second time point that the first rotating member 120 is continuously rotated clockwise, the first elastic member other end 142 may remain in a state of being fixed to one surface of the first rotating member 120 and the first elastic member one end 141 may remain in a state of being fixed to the shaft 190.

Here, in response to clockwise rotation of the first rotating member 120, the first elastic member other end 142 may rotate clockwise. However, since the shaft 190 is not rotated, the first elastic member one end 141 connected to the shaft 190 may not rotate.

Here, due to a second force of the first elastic member one end 141 to the shaft 190, the first elastic member one end 141 may not be rotated.

Here, the second force may be a force by which the first elastic member one end 141 can be fixed to the shaft 190.

The second force may be generated by a frictional force between the first elastic member one end 141 and the shaft 190 or may be generated by an elastic force of the first elastic member on end 141.

Accordingly, since the first elastic member 140 may continuously be expanded clockwise, the first back tension provided to the sheet may be increased.

However, when the first rotating member 120 is continuously rotated clockwise after the second time point, an expansion force of the first elastic member 140 gradually increases in such a way that the first elastic member one end 141 may slip over one surface of the shaft 190.

In detail, when the first elastic member 140 is gradually expanded, a thickness of the first elastic member 140 (in one embodiment of the present invention, it may be a diameter and hereinafter will be identically described with respect to the elastic member) may gradually become increased. As the diameter of the first elastic member 140 becomes increased, the second force between the first elastic member one end 141 and the shaft 190 may gradually weaken and the first force between the first elastic member other end 142 and the first rotating member 120 may strengthen. When the first force of the first elastic member one end 141 becomes smaller by the force caused by expansion of the first elastic member 140, the first elastic member one end 141 may slip over the shaft 190.

The first elastic member 140 may be compressed at a uniform level due to the slip of the first elastic member one end 141 after the second time point and the first back tension may remain at a uniform level.

Also, when the first rotating member 120 is rotated clockwise, the second rotating member 130 connected to the first rotating member 120 may also be rotated clockwise. When the second rotating member 130 is rotated, the second elastic member other end 152 in contact with the inner surface of the second rotating member 130 may also be rotated clockwise.

Here, due to an third force of the second elastic member other end 152 to the second rotating member 130, the second elastic member other end 152 may also be rotated when the second rotating member 130 is rotated.

Here, the third force may be a force by the second elastic member other end 152 can be fixed to the inner surface of the second rotating member 130.

Here, the third force may be generated by a frictional force between the second elastic member other end 152 and the second rotating member 130 or may be generated by an elastic force of the second elastic member other end 152.

Also, as the second elastic member other end 152 is rotated, the second elastic member 150 may be expanded.

Here, the second elastic member one end 151 may also be rotated clockwise by an expansion force generated due to the expansion of the second elastic member 150.

Here, since the second elastic member one end 151 is fixed to the back tension controlling member 160, when the second elastic member one end 151 is rotated clockwise, the back tension controlling member 160 may also be rotated clockwise.

Since a repulsive force generated by the expansion of the second elastic member 150 is used for rotating the back tension controlling member 160, that is, the second elastic member 150 is not constantly expanded and the second elastic member 150 cannot provide the second back tension to the unwound sheet roll.

Unlike this, when the sheet roll is rotated counterclockwise, the first rotating member 120 may be rotated counterclockwise by the fixing member 195. When the first rotating member 120 is rotated, the first elastic member other end 142 in contact with the inner surface of the first rotating member 120 may also be rotated counterclockwise.

Here, due to a first force of the first elastic member other end 142 to the first rotating member 120, the first elastic member other end 142 may also be rotated when the first rotating member 120 is rotated.

Also, as the first elastic member other end 142 is rotated, the first elastic member 140 may be compressed.

Here, since the first elastic member 140 is compressed, the first elastic member other end 142 of the first elastic member 140 transfers a force to the first rotating member 120 clockwise to provide the first back tension to the sheet.

Here, from a first time point that the first rotating member 120 starts being rotated counterclockwise to a second time point that the first rotating member 120 is continuously rotated counterclockwise, the first elastic member other end 142 may remain in a state of being fixed to one surface of the first rotating member 120 and the first elastic member one end 141 may remain in a state of being fixed to the shaft 190.

Here, in response to counterclockwise rotation of the first rotating member 120, the first elastic member other end 142 may rotate counterclockwise. However, since the shaft 190 is not rotated, the first elastic member one end 141 connected to the shaft 190 may not rotate.

Here, due to the second force of the first elastic member one end 141 to the shaft 190, the first elastic member one end 141 may not be rotated.

Accordingly, since the first elastic member 140 may continuously be compressed counterclockwise, the first back tension provided to the sheet may be increased.

However, when the first rotating member 120 is continuously rotated counterclockwise after the second time point, a compression force of the first elastic member 140 gradually increases in such a way that the first elastic member other end 142 may slip over one surface of the first rotating member 120.

In detail, when the first elastic member 140 is gradually compressed, the diameter of the first elastic member 140 may become gradually decreased. As the diameter of the first elastic member 140 becomes decreased, the second force between the first elastic member one end 141 and the shaft 190 may gradually strengthen and the first force between the first elastic member other end 142 and the first rotating member 120 may weaken. When the first force of the first elastic member other end 142 becomes smaller by the force caused by compression of the first elastic member 140, the first elastic member other end 142 may slip.

The first elastic member 140 may be compressed at a uniform level due to the slip of the first elastic member other end 142 after the second time point and the first back tension may remain at a uniform level.

However, if a spiral direction of the first elastic member 140 is formed to be opposite to a state shown in FIG. 2, when the sheet roll is rotated clockwise. The first elastic member 140 is compressed and the first elastic member other end 142 may slip.

Also, if a spiral direction of the first elastic member 140 is formed to be opposite to a state shown in FIG. 2, when the sheet roll is rotated counterclockwise, the first elastic member 140 is expanded and the first elastic member one end 141 may slip.

When the first rotating member 120 is rotated counterclockwise, the second rotating member 130 connected to the first rotating member 120 may also be rotated counterclockwise. When the second rotating member 130 is rotated, the second elastic member other end 152 in contact with the inner surface of the second rotating member 130 may also be rotated counterclockwise. Here, due to an third force of the second elastic member other end 152 to the second rotating member 130, the second elastic member other end 152 may also be rotated when the second rotating member 130 is rotated.

Here, the third force may be generated by a frictional force between the second elastic member other end 152 and the second rotating member 130 or may be generated by an elastic force of the second elastic member other end 152.

Also, as the second elastic member other end 152 is rotated, the second elastic member 150 may be compressed.

Here, the second elastic member one end 151 may also be rotated counterclockwise due to a compression force generated by the compression of the second elastic member 150.

Here, since the second elastic member one end 151 is fixed to the back tension controlling member 160, when the second elastic member one end 151 is rotated counterclockwise, the back tension controlling member 160 may also be rotated counterclockwise.

Since a repulsive force generated by the compression of the second elastic member 150 is used for rotating the back tension controlling member 160, that is, the second elastic member 150 is not constantly compressed and the second elastic member 150 may not provide the second back tension to the unwound sheet roll.

Also, the fixing member 195 has been described as being connected to the first rotating member 120 but is not limited thereto and may be connected only to the second rotating member 130.

Here, when the sheet roll is rotated, the second rotating member 130 may be rotated and the first rotating member 120 may be rotated corresponding to rotation of the second rotating member 130.

However, the fixing member 195 may be connected to both the first rotating member 120 and the second rotating member 130.

Here, when the sheet roll is rotated, the first rotating member 120 and the second rotating member 130 may be rotated.

Next, a change of the unwinding device 100 in position from a state shown in FIG. 6 to a state shown in FIG. 7 will be described.

In the unwinding device 100, the second rotating member 130 may be changed in position based on the first rotating member 120.

For example, when the second rotating member 130 is withdrawn from the first rotating member 120 based on the first rotating member 120, the guide part 129 inserted in the guided portion 133 slides in such a way that the position determining part 132 of the second rotating member 130 may be disposed in the second fastening space S128.

Since the second rotating member 130 may interconnect with the first rotating member 120 regardless of the change in position based on the first rotating member 120, when the first rotating member 120 is rotated, the second rotating member 130 may also be rotated.

Also, corresponding to a position movement of the second rotating member 130, the back tension controlling member 160 may be moved in position.

Here, when the back tension controlling member 160 is moved in position, the back tension connecting part 166 may be inserted into the back tension connected portion 171.

In other words, the back tension connecting part 166 may be inserted into the back tension connected portion 171 due to a position change of the second rotating member 130 based on the first rotating member 120.

In other words, the back tension connecting part 166 may be inserted into the back tension connected portion 171 due to a withdrawal of the second rotating member 130 based on the first rotating member 120.

However, the present invention is not limited to the above-described example.

For example, according to one embodiment of the present invention, when the second rotating member 130 is moved in position, the back tension controlling member 160 may be positioned and connected to an interconnecting member 170.

However, according to another embodiment of the present invention, when the second rotating member 130 is not moved in position, only the back tension controlling member 160 may be moved in position and connected to an interconnecting member 170.

Also, according to still another embodiment of the present invention, only the second elastic member 150 may be moved in position based on the shaft 190 in such a way that the second elastic member 150 may control whether to provide the second back tension.

Also, according to yet another embodiment of the present invention, the back tension connecting part 166 is not formed to protrude from the large diameter part 161*b* and may be formed on one surface of the large diameter part 161*b* as a magnetic body and an interconnecting member 170 may include one surface formed of a magnetic body.

Accordingly, due to a position movement of the second rotating member 130, the back tension controlling member 160 may come into contact with an interconnecting member 170 and the back tension controlling member 160 may be fixed to an interconnecting member 170.

However, not limited thereto, a shape of the back tension connecting part 166 and a shape of the back tension connected portion 171 are variously changeable at a level obvious to one of ordinary skill in the art when having a function of providing the second back tension through a connection between the back tension connecting part 166 and the back tension connected portion 171.

Next, a state, shown in FIG. 7, in which the second rotating member 130 is withdrawn based on the first rotating member 120 will be described.

In FIG. 7, in the case of the unwinding device 100, the second rotating member 130 may be connected to the first rotating member 120 to dispose the position determining part 132 of the second rotating member 130 in the second fastening space S128.

Also, the back tension connecting part 166 may be inserted into the back tension connected portion 171.

Also, while the back tension connecting part 166 is not in contact with the dividing part 172 while being inserted in the back tension connected portion 171, the back tension controlling member 160 may be rotatably put one the shaft 190.

Also, while the back tension connecting part 166 is in contact with the dividing part 172 while being inserted in the back tension connected portion 171, the back tension controlling member 160 may be put on the shaft 190 not to be rotatable.

Since the technical features of the first back tension provided by the first elastic member 140 when the sheet roll is rotated clockwise have been described above, it will be omitted below.

Also, when the first rotating member 120 is rotated clockwise, the second rotating member 130 in contact with the first rotating member 120 may also be rotated clockwise.

When the second rotating member 130 is rotated, the second elastic member other end 152 in contact with the inner surface of the second rotating member 130 may also be rotated clockwise.

Here, due to an third force between the second elastic member other end 152 and the second rotating member 130, the second elastic member other end 152 may also be rotated when the second rotating member 130 is rotated.

Here the third force may be generated according to the same principle as that of the above-described third force.

Also, as the second elastic member other end 152 is rotated, the second elastic member 150 may be expanded.

Here, since the second elastic member 150 is expanded clockwise, a repulsive force (reaction) with respect thereto may be generated. Since the second elastic member other end 152 transfers the repulsive force to the second rotating member 130 counterclockwise, the second elastic member 150 may provide second back tension to the sheet.

Here, from a first time point that the second rotating member 130 starts being rotated clockwise to a second time point that the second rotating member 130 is continuously rotated clockwise, the second elastic member other end 152 may remain in a state of being fixed to one surface of the second rotating member 130 and the second elastic member one end 151 may remain in a state of being fixed to the back tension contact part 161.

Here, corresponding to clockwise rotation of the second rotating member 130, the second elastic member other end 152 may also rotate clockwise.

However, since the back tension controlling member 160 is connected to an interconnecting member 170 not to be rotatable, the second elastic member one end 151 connected to the back tension controlling member 160 may not rotate.

Here, due to an forth force of the second elastic member one end 151 to the back tension contact part 161, the second elastic member one end 151 may not be rotated.

Here, the forth force may be a force by which the second elastic member one end 151 can be fixed to the back tension controlling member 160.

The forth force may be generated by a frictional force between the second elastic member other end 151 and the back tension controlling member 160 or may be generated by an elastic force of the second elastic member other end 151.

Accordingly, from the first time point to the second time point, the second elastic member 150 may continuously be expanded and the second back tension provided to the sheet may also be increased.

However, when the second rotating member 130 is continuously rotated clockwise after the second time point, an expansion force of the second elastic member 150 gradually increases in such a way that the second elastic member one end 151 may slip over one surface of the back tension contact part 161.

Since the second elastic member one end 151 slips due to the same principle in which the first elastic member 140 expands, a repeated description will be omitted.

Accordingly, the second elastic member 150 may be expanded at a uniform level due to the slip of the second elastic member other end 152 after the second time point and the second back tension may remain at a uniform level.

Since the technical features of the first back tension provided by the first elastic member 140 when the sheet roll is rotated counterclockwise unlike this have been described above, it will be omitted below.

When the first rotating member 120 is rotated counterclockwise, the second rotating member 130 connected to the first rotating member 120 may also be rotated counterclockwise.

When the second rotating member 130 is rotated, the second elastic member other end 152 in contact with the inner surface of the second rotating member 130 may also be rotated counterclockwise.

Here, due to an third force between the second elastic member other end 152 and the second rotating member 130, the second elastic member other end 152 may also be rotated when the second rotating member 130 is rotated.

Here the third force may be generated according to the same principle as that of the above-described third force.

Also, as the second elastic member other end 152 is rotated, the second elastic member 150 may be compressed.

Here, since the second elastic member 150 is compressed counterclockwise, a repulsive force (reaction) with respect thereto may be generated.

Since the second elastic member other end 152 transfers the repulsive force to the second rotating member 130 clockwise, the second elastic member 150 may provide second back tension to the sheet.

Here, from a first time point that the second rotating member 130 starts being rotated counterclockwise to a second time point that the second rotating member 130 is continuously rotated counterclockwise, the second elastic member other end 152 may remain in a state of being fixed to one surface of the second rotating member 130 and the second elastic member one end 151 may remain in a state of being fixed to the back tension contact part 161.

Here, corresponding to counterclockwise rotation of the second rotating member 130, the second elastic member other end 152 may rotate counterclockwise. However, since the back tension controlling member 160 is connected to an interconnecting member 170 not to be rotatable, the second elastic member one end 151 connected to the back tension controlling member 160 may not rotate.

Here, due to an forth force of the second elastic member one end 151 to the back tension contact part 161, the second elastic member one end 151 may not be rotated.

Accordingly, from the first time point to the second time point, the second elastic member 150 may continuously be compressed and the second back tension provided to the sheet may also be increased.

However, when the second rotating member 130 is continuously rotated counterclockwise after the second time point, a compression force of the second elastic member 150 gradually increases in such a way that the second elastic member other end 152 may slip over one surface of the second rotating member 130.

Since the second elastic member other end 152 slips due to the same principle in which the first elastic member 140 compressions, a repeated description will be omitted.

Accordingly, the second elastic member 150 may be compressed at a uniform level due to the slip of the second elastic member one end 151 after the second time point and the second back tension may remain at a uniform level.

However, if a spiral direction of the second elastic member 150 is formed to be opposite to a state shown in FIG. 2, when the sheet roll is rotated clockwise, the second elastic member 150 is compressed and the second elastic member other end 152 may slip.

Also, if a spiral direction of the second elastic member 150 is formed to be opposite to a state shown in FIG. 2, when the sheet roll is rotated counterclockwise, the second elastic member 150 is expanded and the second elastic member one end 151 may slip.

3. Tensioning Device for Printer

Figure 14:
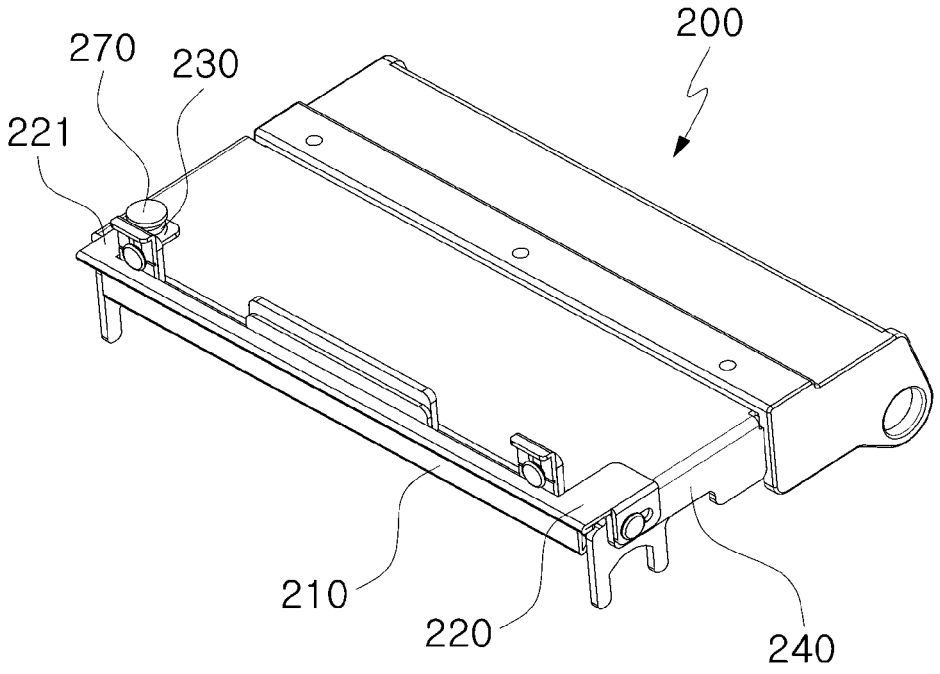
FIG. 14 is a combination perspective view of a tensioning device for a printer, which is provided at the printer according to one embodiment of the present invention.

FIG. 14 is a combination perspective view of the tensioning device for a printer, which is provided at the printer according to one embodiment of the present invention.

Referring to FIG. 14, the tensioning device 200 for improving precision of printing using a sheet by applying tension to the sheet may include a frame 240, a first tensioning member 210 that provides first tension to the sheet using a pressure caused by contact with at least part of a first line of the sheet and changes a level of the first tension by moving position based on the frame 240, and a second tensioning member 220 that provides second tension to the sheet using a pressure caused by contact with at least part of a second line of the sheet and changes a level of the second tension by moving position based on the frame 240.

Here, the first tensioning member 210 and the second tensioning member 220 are arranged to form a certain gap between the first line and the second line to minutely adjust tension provided to the sheet.

Here, the first line may refer to a random line with respect to a lateral direction of the sheet and may be a part at which the first tensioning member 210 comes into contact with the sheet.

Here, the second line may refer to a random line with respect to the lateral direction of the sheet and may be a part at which the second tensioning member 220 comes into contact with the sheet.

Also, a first region and a second region is defined by dividing a width of a sheet R.

Here, an area of the first region may be identical to an area of the second region but are not limited thereto and the area of the first region may be larger than the area of the second region. Also, the area of the second region may be larger than the area of the second region.

Figure 15:
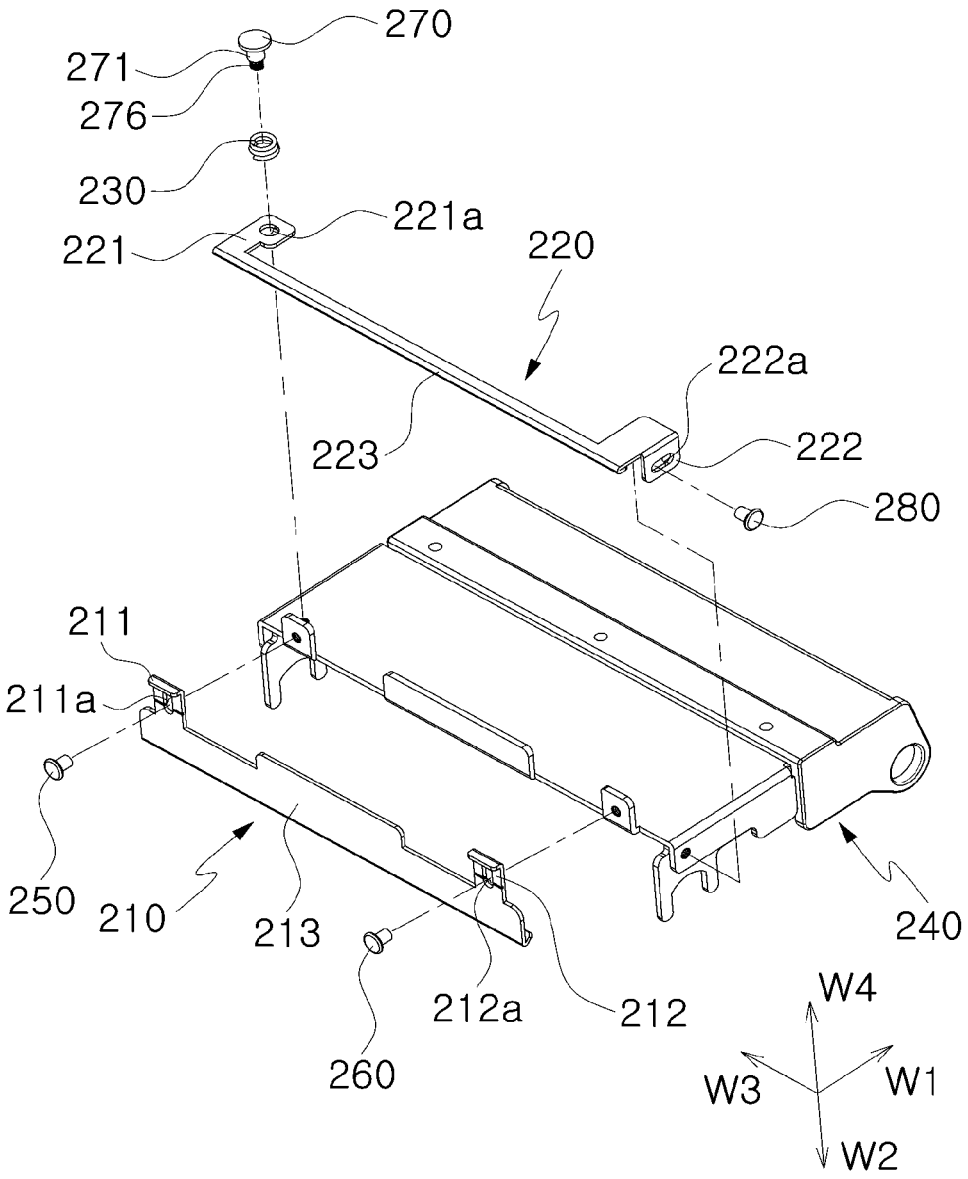
FIG. 15 is an exploded perspective view of the tensioning device for a printer, which is provided at the printer according to one embodiment of the present invention.

FIG. 15 is an exploded perspective view of the tensioning device for a printer, which is provided at the printer according to one embodiment of the present invention.

Referring to FIG. 15, the first tensioning member 210 may include a first contact part 213 in contact with at least part of the first line of the sheet and a first connecting part 211 and a second connecting part 212 connected to the frame 240 with a first fastening member 250 and a second fastening member 260 fixed to the frame 240 as media.

Here, the first fastening member 250 and the second fastening member 260 may have top ends and bottom ends with thicknesses different from each other and the thickness of the bottom ends may be smaller than the thickness of the top ends.

Also, spiral threads may be formed at parts of the bottom ends of the first fastening member 250 and the second fastening member 260 to be connected to the frame 240.

Also, the first tensioning member 210 may be connected to the frame 240 in a first direction w1 with respect to the frame 240.

In other words, the first connecting part 211 and the second connecting part 212 may be connected to the frame 240 in the first direction w1 with respect to the frame 240.

Also, the first connecting part 211 may include a first hole 211*a* to allow the first fastening member 250 to be inserted therein.

Here, the first hole 211*a* may be formed passing through from one surface to the other surface of the first connecting part 211 and a width of the first hole 211*a* may be greater than a thickness of a bottom end of the first fastening member 250.

Also, the first hole 211*a* may be formed to be rounded.

Since the width of the first hole 211*a* is formed to be greater than the thickness of the bottom end of the first fastening member 250 or to be rounded, a rotational movement of the first tensioning member 210 that will be described below may be performed.

However, not limited thereto, the width of the first hole 211*a* may be identical to the thickness of the bottom end of the first fastening member 250.

Also, the second connecting part 212 may include a second hole 212*a* to allow the second fastening member 260 to be inserted therein.

Here, the second hole 212*a* may be formed passing through from one surface to the other surface of the second connecting part 212 and a width of the second hole 212*a* may be greater than a thickness of a bottom end of the second fastening member 260.

Also, the second hole 212*a* may be formed to be rounded.

Since the width of the second hole 212*a* is formed to be greater than the thickness of the bottom end of the second fastening member 260 or to be rounded, a rotational movement of the first tensioning member 210 that will be described below may be performed.

However, not limited thereto, the width of the second hole 212*a* may be identical to the thickness of the bottom end of the second fastening member 260.

The second tensioning member 220 may include a second contact part 223 in contact with at least part of the second line of the sheet and a third connecting part 221 and a fourth connecting part 222 connected to the frame 240 with a third fastening member 270 and a fourth fastening member 280 fixed to the frame 240 as media.

Here, the third fastening member 270 and the fourth fastening member 280 may have top ends and bottom ends with thicknesses different from each other and the thickness of the bottom ends may be smaller than the thickness of the top ends.

Also, a third fastening screw part 276 to be easily connected to the frame 240 and a third fastening one surface part 271 with no screw thread may be formed at a bottom end of the third fastening member 270.

Also, a spiral thread may be formed at part of the bottom end of the fourth fastening member 280 to be connected to the frame 240.

Also, the third connecting part 221 may include a third hole 221*a* to allow the third fastening member 270 to be inserted therein.

Here, the third hole 221*a* may be formed passing through one surface to the other surface of the third connecting part 221.

Also, the fourth connecting part 222 may include a fourth hole 222*a* to allow the fourth fastening member 280 to be inserted therein.

Here, the fourth hole 222*a* may be formed passing through from one surface to the other surface of the fourth connecting part 222 and a width of the fourth hole 222*a* may be greater than a thickness of the bottom end of the fourth fastening member 280.

Also, the fourth hole 222*a* may be formed to be rounded.

Also, the third connecting part 221 may be connected to the frame 240 by the third fastening member 270 in a second direction w2 that meets the first direction w1 at a certain angle or is perpendicular thereto with respect to the frame 240 and the fourth connecting part 222 may be connected to the frame 240 by the fourth fastening member 280 in a direction different from the second direction w2 with respect to the frame 240.

For example, the fourth connecting part 222 may be connected to the frame 240 in a third direction w3 perpendicular to the second direction w2.

For this, the third connecting part 221 may be positioned with the second contact part 223 in a first virtual plane and the fourth connecting part 222 may be positioned in a second plane perpendicular to the first plane.

In other words, the third fastening member 270 and the fourth fastening member 280 may be fixed to a top surface and a side surface of the frame 240, respectively.

However, the first plane and the second plane are not limited to being perpendicular to each other and may have a certain angel between the first plane and the second plane. Accordingly, the third connecting part 221 and the fourth connecting part 222 may have a certain angle.

Since the third connecting part 221 and the fourth connecting part 222 are formed at the second tensioning member 220 to have a certain angle, a rotational movement of the second tensioning member 220 may be smoothly performed.

Also, the first contact part 213 may have a certain angle with the second contact part 223.

In more detail, since the first connecting part 211 and the second connecting part 212 are connected to the frame 240 in the first direction w1 with respect to the frame 240 and the third connecting part 221 may be connected to the frame 240 in the second direction w2 with respect to the frame 240.

Also, the first contact part 213 is positioned in a third virtual plane including the first connecting part 211 and the second connecting part 212 and the second contact part 223 may be positioned in the first virtual plane including the third connecting part 221.

Accordingly, the first contact part 213 and the second contact part 223 may have the certain angle.

Accordingly, since the first contact part 213 and the second contact part 223 have the certain angle, a certain interval may be formed between the first line and the second line and tension provided to the sheet may be minutely adjusted.

To allow the second tensioning member 220 to be movable along a transfer direction of the sheet, a third elastic member 230 may pressurize the second tensioning member 220.

In detail, the third elastic member 230 may be disposed between the third fastening member 270 and the third connecting part 221. The third fastening one surface part 271 may be disposed in the third elastic member 230.

Because of this arrangement, the third elastic member 230 may contract or expand according to a movement of the second tensioning member 220.

Hereinafter, a process in which the tensioning device 200 according to one embodiment of the present invention operates to provide tension to the sheet will be described.

The directions shown in FIG. 15 may be omitted within the same range in the drawings.

Hereinafter, a sheet will be described based on a ribbon R (refer to FIG. 1) but not intended to limit the use of the present invention.

Figure 16:
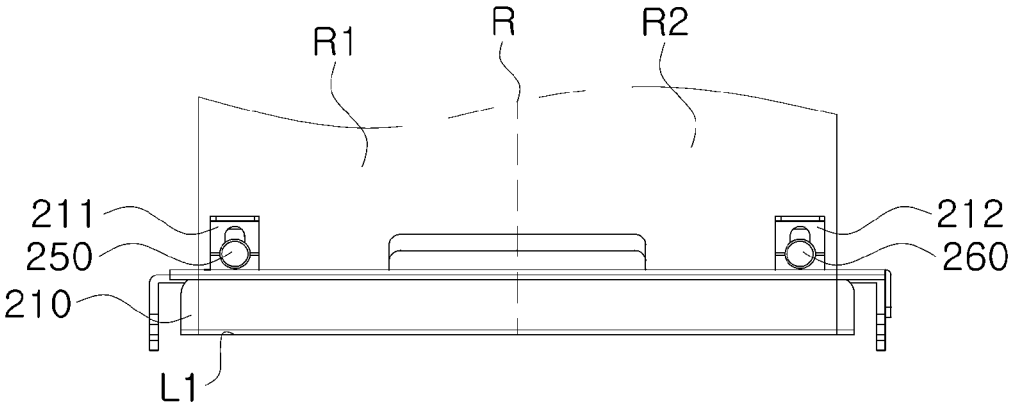
FIGS. 16 and 17 are views illustrating a linear movement of a first tensioning member provided at the tensioning device for a printer according to one embodiment of the present invention.
Figure 17:
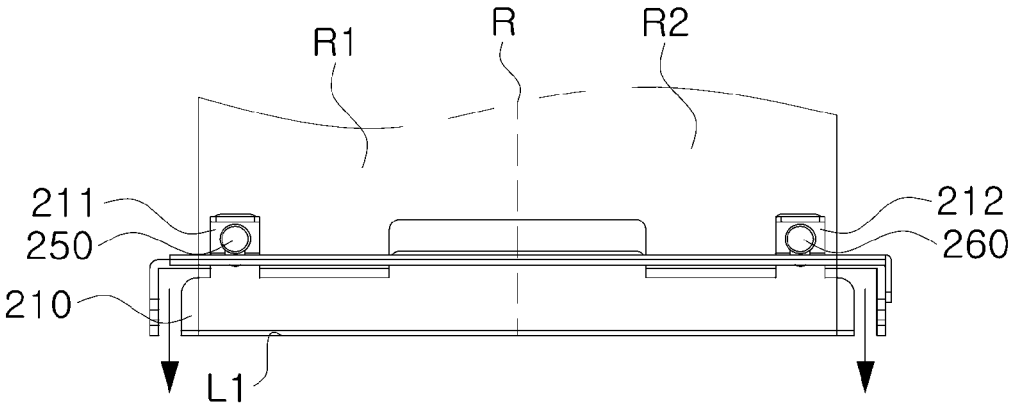

FIGS. 16 and 17 are views illustrating a linear movement of the first tensioning device provided at the tensioning device according to one embodiment of the present invention.

The first tensioning member 210 may provide the first tensions at the same level to a first region R1 and a second region R2 defined by dividing a width of a ribbon R through a linear movement based on the frame 240 (refer to FIG. 15).

In other words, the first connecting part 211 and the second connecting part 212 slide based on the first fastening member 250 and the second fastening member 260 and provide the first tensions at the same level to the first region R1 and the second region R2.

In detail, the first tensioning member 210 may be moved in position from a state shown in FIG. 16 to a state shown in FIG. 17 and may provide the first tensions at the same level to the first region R1 and the second region R2 of the ribbon R.

The first connecting part 211 may slide in the second direction w2 (refer to FIG. 15) based on the first fastening member 250 and the second connecting part 212 may slide by the same distance as a distance by which the first connecting part 211 slides in the second direction w2 based on the second fastening member 260 to provide the first tensions at the same level to the first region R1 and the second region R2.

Thereby, it is possible to overcome a limitation in which a printing operation is not adequately performed because tension is not adequately applied to the ribbon R.

For example, like the form of the printer shown in FIG. 2, adequate tension is applied to the ribbon R to prevent the ribbon R from being overlapped, not disposed at a preset distance from the paper P (refer to FIG. 1), or not disposed at a preset distance from the printer head, to smoothly perform printing on the paper P.

Also, it is possible to smoothly perform a printing process by applying adequate tension to the ribbon R in the printer at which printing is directly performed on the ribbon R shown in FIGS. 16 and 17.

Here, a user may manually move the first tensioning member 210 in position by operating the first fastening member 250 and the second fastening member 260. Also, as the above-described example, the first tensioning member 210 has been described as sliding in the second direction w2 but is not limited thereto and may slide in a direction different from the second direction w2 through a change in design at a degree obvious to one of ordinary skill in the art.

Unlike FIGS. 16 and 17, elastic members may be disposed at the first fastening member 250 and the second fastening member 260.

Accordingly, the first tensioning member 210 may be moved in position in the first direction w1 (refer to FIG. 1) or a direction different w1 from the first direction due to a movement of a ribbon R to minutely adjust the first tension provided to the ribbon R.

Figure 18:
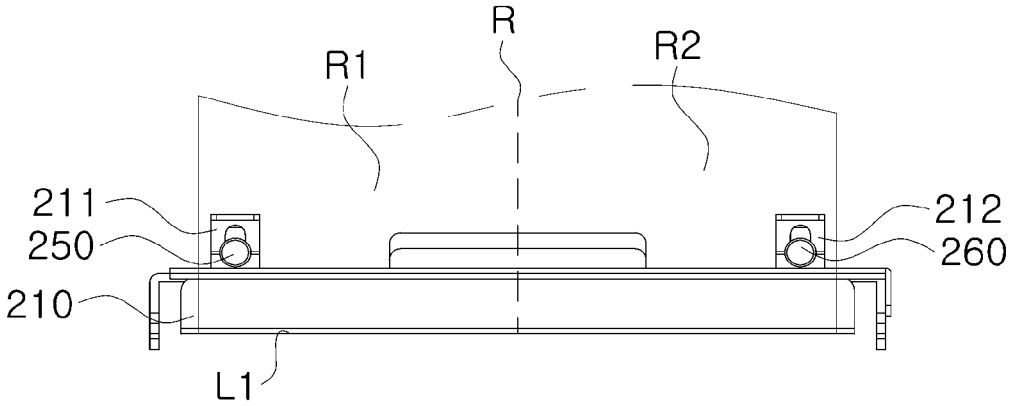
FIGS. 18 to 20 are views illustrating a rotational movement of the first tensioning member provided at the tensioning device for a printer according to one embodiment of the present invention.
Figure 19:
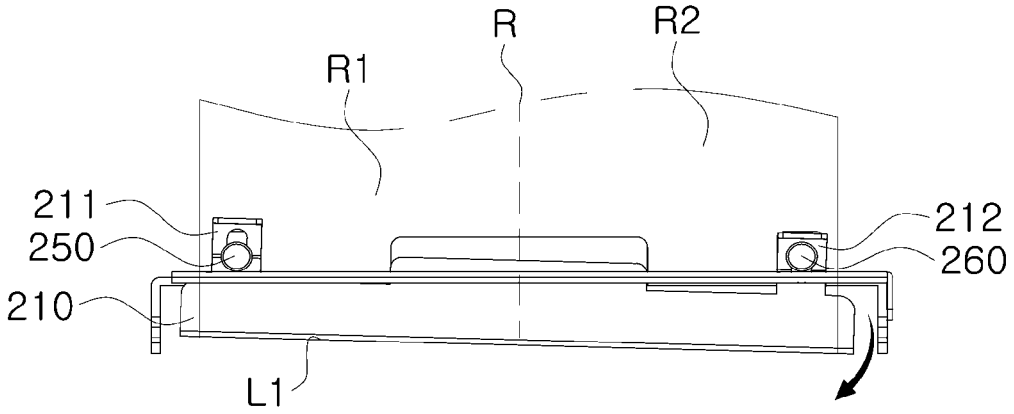
Figure 20:
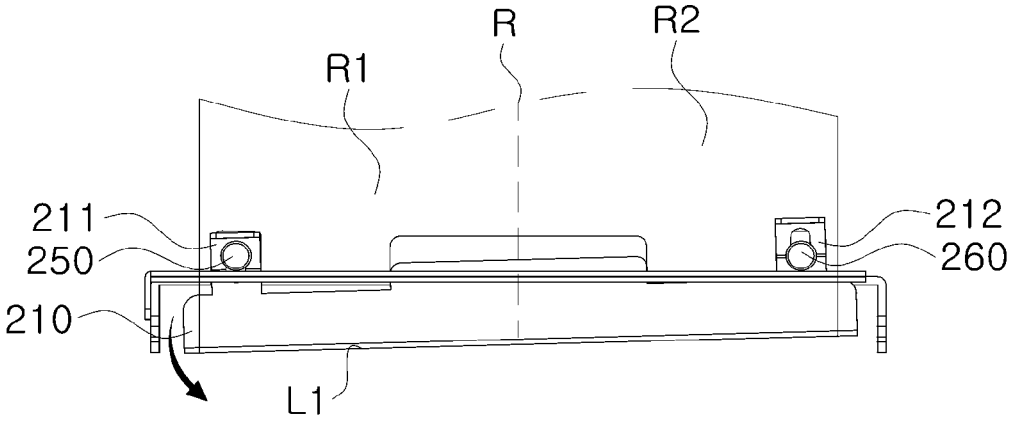

FIGS. 18 to 20 are views illustrating a rotational movement of the first tensioning device provided at the tensioning device according to one embodiment of the present invention.

The first tensioning member 210 may provide first tensions at different levels to the first region R1 and the second region R2 when being moved in position based on the frame 240 (refer to FIG. 15).

In other words, the first fastening member 250 may be a center of rotation of the first contact part 213 to provide greater tension to the second region R2 than that provided to the first region R1.

Also, the second fastening member 260 may be a center of rotation of the first contact part 213 to provide greater tension to the first region R1 than that provided to the second region R2.

In detail, the first tensioning member 210 may provide greater first tension to the second region R2 than that provided to the first region R1 when being moved in position from a state shown in FIG. 18 to a state shown in FIG. 19 and may provide greater first tension to the first region R1 than that provided to the second region R2 when being moved in position from the state shown in FIG. 18 to a state shown in FIG. 20.

In other words, the first tensioning member 210 may be rotated toward the first line L1 based on the first fastening member 250. Here, the second connecting part 212 may slide based on the second fastening member 260.

Thereby, the first tensioning member 210 may provide greater first tension to the second region R2 than that provided to the first region R1.

Also, the first tensioning member 210 may be rotated toward the first line L1 based on the second fastening member 260. Here, the first connecting part 211 may slide based on the first fastening member 250.

Thereby, the first tensioning member 210 may provide greater first tension to the first region R1 than that provided to the second region R2.

According to one embodiment of the present invention, when a printing process is not smoothly performed due to different levels of tensions applied to the first region and the second region, the printing process may be smoothly performed by adequately adjusting tensions to the first region and the second region.

Also, as described above, the first fastening member 250 and/or the second fastening member 260 may be manually operated to move the first tensioning member 210 in position.

Figure 21:
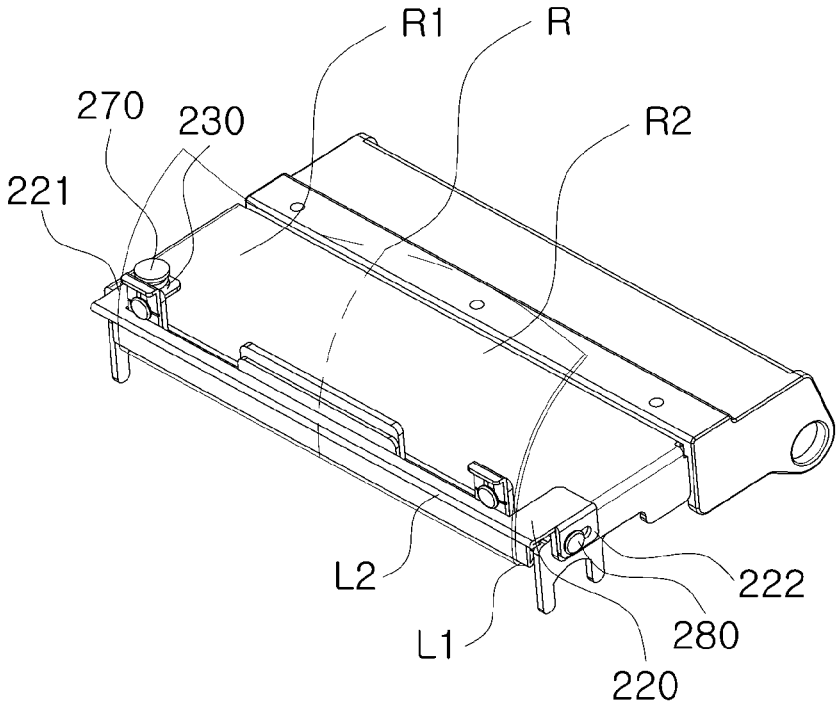
FIGS. 21 and 22 are views illustrating a rotational movement of a second tensioning member provided at the tensioning device for a printer, based on a third fastening member according to one embodiment of the present invention.
Figure 22:
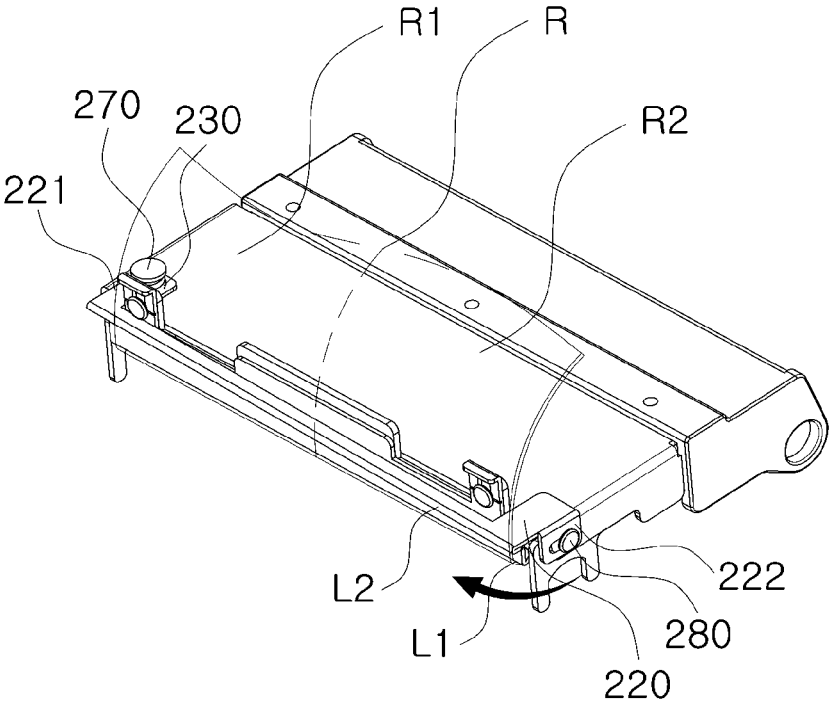

FIGS. 21 and 22 are views illustrating a rotational movement of the second tensioning device provided at the tensioning device based on the third fastening member according to one embodiment of the present invention.

The second tensioning member 220 may provide second tensions at different levels to the first region R1 and the second region R2 defined by dividing the width of the ribbon R when being moved in position based on the frame 240 (refer to FIG. 15).

In other words, the third connecting part 221 may be connected to the frame 240 with the third fastening member 270 as a medium to allow the second contact part 223 (refer to FIG. 15) to be rotatable based on the third fastening member 270.

The fourth connecting part 222 may be connected to the frame 240 with the fourth fastening member 280 as a medium to be slidable based on the fourth fastening member 280.

In detail, the second tensioning member 220 (refer to FIG. 15) may be moved in position from a state shown in FIG. 21 to a state shown in FIG. 22 and may provide greater tension to the second region R2 than that provided to the first region R1 of the ribbon R.

In other words, the fourth connecting part 222 may be rotated toward the second line L2 based on the third fastening member 270. Here, the fourth connecting part 222 may slide based on the fourth fastening member 280.

Thereby, the second tensioning member 220 may provide greater second tension to the second region R2 than that provided to the first region R1.

A printing operation may not be smoothly performed when tension applied to the ribbon R in the second region R2 is smaller than that applied to the ribbon R in the first region R1 or a path of the ribbon R in the second region R2 is longer than a path of the ribbon R in the first region R1.

According to one embodiment of the present invention, the above-described limitation may be effectively overcome by adjusting tension between the first region R1 and the second region R2.

Here, a user may operate only the fourth fastening member 280 and then may rotate the second tensioning member 220 tensioning member 220 Since the third elastic member 230 pressurizes the third connecting part 221, the second tensioning member 220 may be movable in position even though the third fastening member 270 is not operated.

Figure 23:
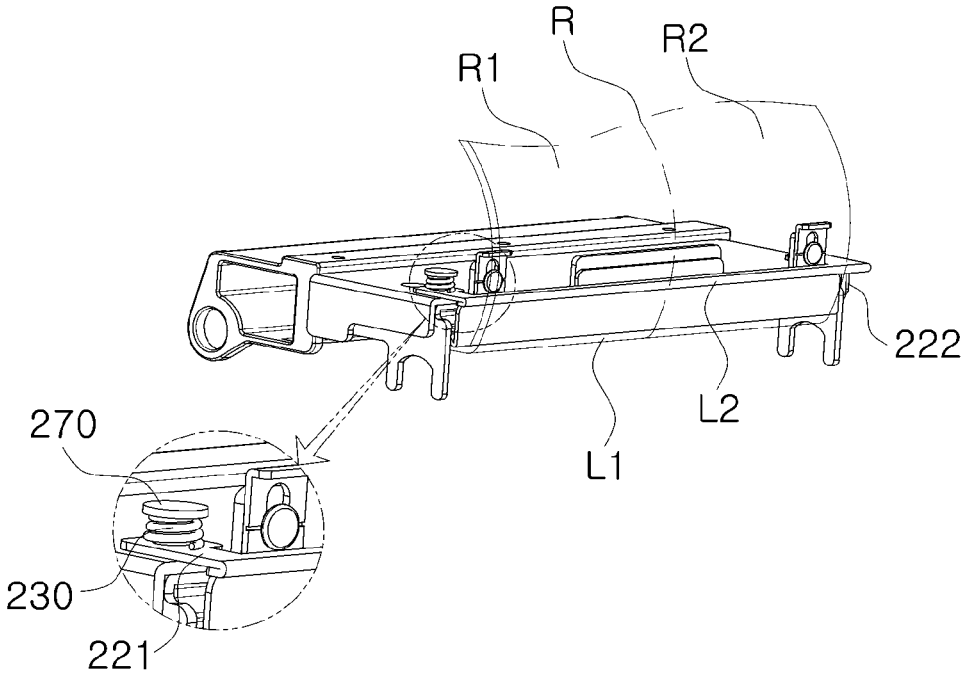
FIGS. 23 and 24 are views illustrating a rotational movement of the second tensioning member provided at the tensioning device for a printer, based on a fourth fastening member according to one embodiment of the present invention.
Figure 24:
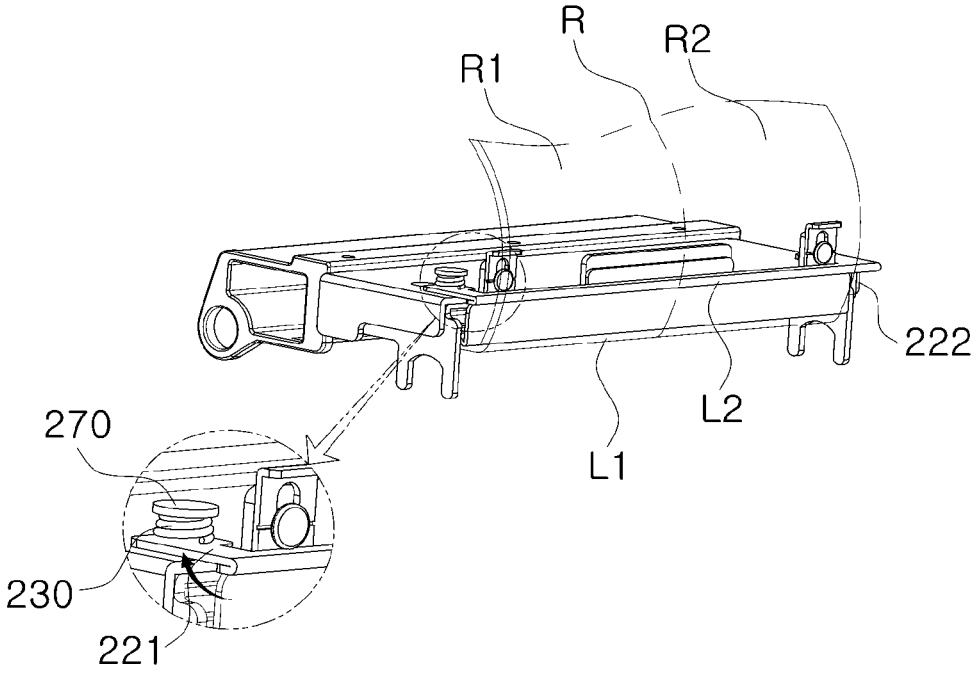

FIGS. 23 and 24 are views illustrating a rotational movement of the second tensioning device provided at the tensioning device based on the fourth fastening member according to one embodiment of the present invention.

The third elastic member 230 may allow the second contact part 223 (refer to FIG. 15) to be moved along a transfer direction of the ribbon R based on the fourth fastening member 280 (refer to FIG. 15).

In other words, the third elastic member 230 may be disposed between the third fastening member 270 and the third connecting part 221 to pressurize the third connecting part 221.

However, since the third elastic member 230 is contractible and expandable, when an upward force is applied to the second contact part 223, the third elastic member 230 may be contracted and may allow the second contact part 223 to be moved upward in position. Also, when a downward force is applied to the second contact part 223, the third elastic member 230 may be expanded and may allow the second contact part 223 to be moved downward in position.

Here, an upward direction and a downward direction may be a fourth direction w4 (refer to FIG. 15) and the second direction w2 (refer to FIG. 15), respectively, but are not limited thereto and may be variously changed at a level obvious to one of ordinary skill in the art.

Here, the third connecting part 221 may be rotated in the fourth direction w4 or the second direction w2 based on the fourth fastening member 280 and the third connecting part 221 may slide based on the third fastening member 270.

In more detail, referring to FIGS. 23 and 24, when tension applied to the ribbon R below the second line L2 is greater than tension applied to the ribbon R above the second line L2, the second tensioning member 220 may be moved in position from a state shown in FIG. 23 to a state shown in FIG. 24.

Also, when tension applied to the ribbon R above the second line L2 is greater than tension applied to the ribbon R below the second line L2, the second tensioning member 220 may rotate from the state shown in FIG. 23 in the second direction w2 (refer to FIG. 15) based on the fourth fastening member 280 (refer to FIG. 15) or may be moved in position from the state shown in FIG. 24 to the state shown in FIG. 23.

For reference, the fourth direction w4 may be a direction opposite to the second direction w2. However, a design is changeable at a level obvious to one of ordinary skill in the art to allow the third connecting part 221 to rotate in a direction different from the second direction w2 and the fourth direction w4 based on the fourth fastening member 280.

Figure 25:
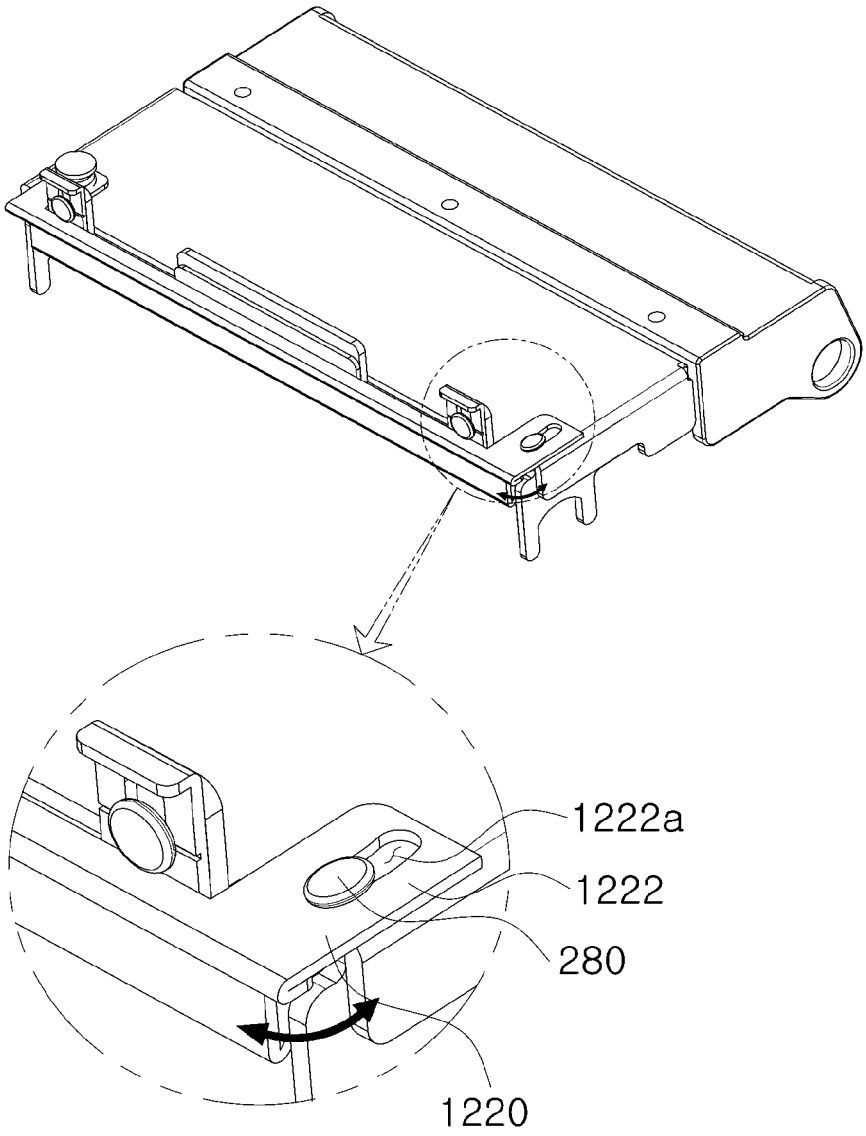
FIG. 25 is a combination perspective view of a tensioning device for a printer according to another embodiment of the present invention.

FIG. 25 is a combination perspective view of a tensioning device for a printer according to another embodiment of the present invention.

Referring to FIG. 25, a fourth connecting part 1222 of a second tensioning device 1220 may be connected to the frame 240 (refer to FIG. 15) by the fourth fastening member 280 in the second direction w2 (refer to FIG. 15) with respect to the frame 240.

In other words, the second contact part 223 (refer to FIG. 15), the third connecting part 221 (refer to FIG. 15), and the fourth connecting part 1222 may be positioned in a first virtual plane.

That is, the third connecting part 221 and the fourth connecting part 1222 may be connected to the same surface of the frame 240.

Here, a fourth hole 1222*a* may be formed in the fourth connecting part 1222 to be rounded.

Since the fourth hole 1222*a* is formed to be rounded, the fourth connecting part 1222 may be easily rotated based on the third fastening member 270 (refer to FIG. 15).

Here, the fourth connecting part 1222 may slide based on the fourth fastening member 280.

Figure 26:
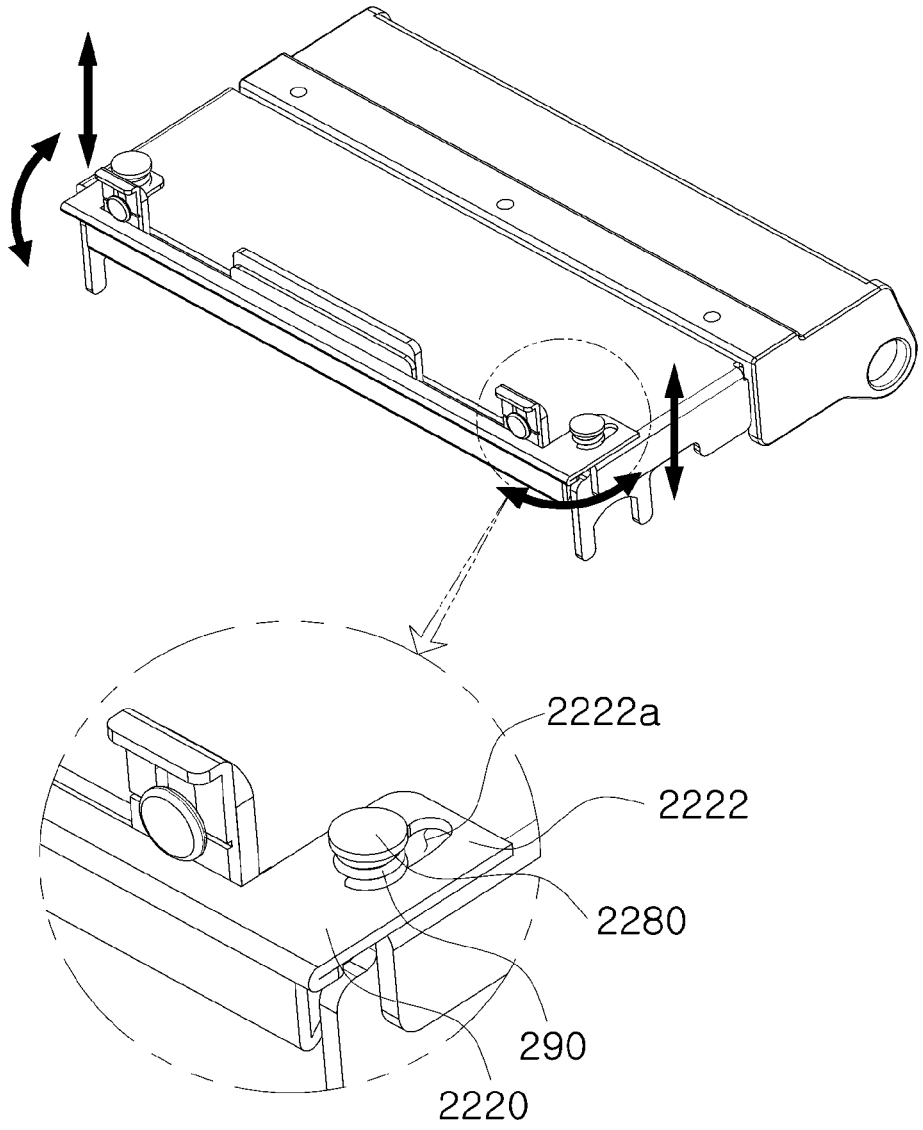
FIG. 26 is a combination perspective view of a tensioning device for a printer according to still another embodiment of the present invention.

FIG. 26 is a combination perspective view of a tensioning device for a printer according to still another embodiment of the present invention.

Referring to FIG. 26, a fourth connecting part 2222 of a second tensioning device 2220 may be connected to the frame 240 (refer to FIG. 15) by a fourth fastening member 2280 in the second direction w2 (refer to FIG. 15) with respect to the frame 240.

In other words, the second contact part 223 (refer to FIG. 15), the third connecting part 221 (refer to FIG. 15), and the fourth connecting part 2222 may be positioned in a first virtual plane.

That is, the third connecting part 221 and the fourth connecting part 2222 may be connected to the same surface of the frame 240.

Here, the fourth fastening member 2280 may be in a different form from the fourth fastening member 280 (refer to FIG. 15) that is described in above embodiments.

That is, the fourth fastening member 2280 may be in a same form to the fourth fastening member 280 (refer to FIG. 15) that is described in above embodiments.

Also, the tensioning device 200 (refer to FIG. 14) may further include a fourth elastic portion 290.

The fourth elastic portion 290 may be mounted on the fourth fastening member 2280 to pressurize the fourth connecting part 2222 toward the frame 240.

Here, the fourth connecting part 2222 may be rotated based on the third fastening member 270 even though the fourth fastening member 2280 is not manually operated, that is, not released from screw-coupling with the frame 240.

This is because the fourth elastic portion 290 is disposed between the fourth connecting part 2222 and the fourth fastening member 2280.

A detailed description thereof will be omitted within a repeated range of the above description.

Also, the third connecting part 221 may be rotated based on the fourth fastening member 2280 and the fourth connecting part 2222 may be rotated based on the third fastening member 270.

In more detail, the third connecting part 221 is rotated based on the fourth fastening member 2280 in such a way that the second tensioning member 220 may provide greater second tension to the first region R1 (refer to FIGS. 16 to 24) than that provided to the second region R2 (refer to FIGS. 16 to 24).

Also, the fourth connecting part 2222 may be rotated based on the third fastening member 270 in such a way that the second tensioning member 220 may provide greater second tension to the second region R2 than that provided to the first region R1.

Also, when tension applied to the ribbon below the second line L2 is greater than tension applied to the ribbon above the second line L2, the second tensioning device 2220 may be linearly moved in the fourth direction w4 (refer to FIG. 15).

Also, when tension applied to the ribbon above the second line L2 is greater than tension applied to the ribbon below the second line L2, the second tensioning device 2220 may be linearly moved in the second direction w2 (refer to FIG. 15).

Here, the second tensioning device 2220 is not limited in being moved in position in the second direction w2 and/or the fourth direction w4 and may be changed in design to be linearly moved in position in a direction different from the second direction w2 and/or the fourth direction w4 at a level obvious to one of ordinary skill in the art.

According to the embodiments of the present invention, a tensioning device for a printer, an unwinding device for a printer, and a printer may output precisely and definitely information to be transmitted on a sheet.

Also, the printer may be prevented from being out of order.

Effects of the present invention will not be limited to the above-described and others not set forth above will be definitely understood by one of ordinary skill in the art from the specification and the attached drawings.

In the attached drawings, components irrelevant to or less relevant to the technical concept of the present invention have been simplified or omitted to more clearly express the technical concept of the present invention.

Although the embodiments of the present disclosure have been shown and described, it would be appreciated by those skilled in the art that changes may be made in these embodiments without departing from the principles and spirit of the present disclosure, the scope of which is defined in the claims and their equivalents.

What is claimed is:

1. A printer comprising:

a tension application device for the printer which applies tension to a sheet to increase accuracy of printing using the sheet and comprising:

a frame;

a first tension application portion which provides first tension to the sheet by a pressure caused by contact with at least a part of a first line of the sheet and changes a level of the first tension by shifting a position based on the frame; and a second tension application portion which provides second tension to the sheet by a pressure caused by contact with at least a part of a second line of the sheet and which changes a level of the second tension by shifting a position based on the frame; and a printing device which realizes printing using the sheet, wherein the first tension application portion and the second tension application portion are arranged to form a certain sized gap between the first line and the second line to allow the tension applied to the sheet to be minutely adjustable, wherein the first tension application portion comprises a first contact portion, which comes into contact with at least a part of the line of the sheet, and a first connection portion and a second connection portion respectively connected to the frame with a first fastening portion and a second fastening portion fixed to the frame as media, wherein the first connection portion and the second connection portion slide on the basis of the first fastening portion and the second fastening portion and provide the first tension at the same level to a first area and a second area which are defined by dividing a width of the sheet into two areas by linear movement based on the frame, wherein the first area is closer to the first fastening portion than the second fastening portion and the second area is closer to the second fastening portion than the first fastening portion, and wherein the first fastening portion is a center of rotation of the first contact portion for providing tension, which is higher than that to the first area, to the second area.

2. A tension application device for a printer which applies tension to a sheet to increase accuracy of printing using the sheet, the device comprising:

a frame;

a first tension application portion which provides first tension to the sheet by a pressure caused by contact with at least a part of a first line of the sheet and changes a level of the first tension by shifting a position based on the frame; and a second tension application portion which provides second tension to the sheet by a pressure caused by contact with at least a part of a second line of the sheet and which changes a level of the second tension by shifting a position based on the frame, wherein the first tension application portion and the second tension application portion are arranged to form a certain sized gap between the first line and the second line to allow the tension applied to the sheet to be minutely adjustable, wherein the first tension application portion comprises a first contact portion, which comes into contact with at least a part of the line of the sheet, and a first connection portion and a second connection portion respectively connected to the frame with a first fastening portion and a second fastening portion fixed to the frame as media, wherein the first connection portion and the second connection portion slide on the basis of the first fastening portion and the second fastening portion and provide the first tension at the same level to a first area and a second area which are defined by dividing a width of the sheet into two areas by linear movement based on the frame, wherein the first area is closer to the first fastening portion than the second fastening portion and the second area is closer to the second fastening portion than the first fastening portion, and wherein the first fastening portion is a center of rotation of the first contact portion for providing tension, which is higher than that to the first area, to the second area.

3. The tension application device of claim 2, wherein the second fastening portion is a center of rotation of the first contact portion for providing tension, which is higher than that to the second area, to the first area.

4. A tension application device for a printer which applies tension to a sheet to increase accuracy of printing using the sheet, the device comprising:

a frame;

a first tension application portion which provides first tension to the sheet by a pressure caused by contact with at least a part of a first line of the sheet and changes a level of the first tension by shifting a position based on the frame; and a second tension application portion which provides second tension to the sheet by a pressure caused by contact with at least a part of a second line of the sheet and which changes a level of the second tension by shifting a position based on the frame, wherein the first tension application portion and the second tension application portion are arranged to form a certain sized gap between the first line and the second line to allow the tension applied to the sheet to be minutely adjustable, wherein the second tension application portion provides tensions at different levels to a first area and a second area which are defined by dividing a width of the sheet into two areas when a position is shifted on the basis of the frame, wherein the second tension application portion comprises a second contact portion, which comes into contact with at least a part of the second line of the sheet, and a third connection portion and a fourth connection portion respectively connected to the frame with a third fastening portion and a fourth fastening portion fixed to the frame as media, wherein the third connection portion is connected to the frame with the third fastening portion as a medium such that the second contact portion is rotatable on the basis of the third fastening portion, and wherein the fourth connection portion is connected to the frame with the fourth fastening portion as a medium to be slidable on the basis of the fourth fastening portion.

5. The tension application device of claim 4, further comprising an elastic portion mounted on the third fastening portion such that the third connection portion is pressurized toward the frame, wherein the elastic portion allows the second contact portion to be movable along a transfer direction of the sheet on the basis of the fourth fastening portion.

6. The tension application device of claim 4, wherein the third fastening portion and the fourth fastening portion are respectively fixed to a top surface and a side surface of the frame.

7. A printer comprising:

a tension application device for the printer which applies tension to a sheet to increase accuracy of printing using the sheet and comprises a frame, a first tension application portion which provides first tension to the sheet by a pressure caused by contact with at least a part of a first line of the sheet and changes a level of the first tension by shifting a position based on the frame, and a second tension application portion which provides second tension to the sheet by a pressure caused by contact with at least a part of a second line of the sheet and which changes a level of the second tension by shifting a position based on the frame; and a printing device which realizes printing using the sheet, wherein the first tension application portion and the second tension application portion are arranged to form a certain sized gap between the first line and the second line to allow the tension applied to the sheet to be minutely adjustable, wherein the second tension application portion provides tensions at different levels to a first area and a second area which are defined by dividing a width of the sheet into two areas when a position is shifted on the basis of the frame, wherein the second tension application portion comprises a second contact portion, which comes into contact with at least a part of the second line of the sheet, and a third connection portion and a fourth connection portion respectively connected to the frame with a third fastening portion and a fourth fastening portion fixed to the frame as media, wherein the third connection portion is connected to the frame with the third fastening portion as a medium such that the second contact portion is rotatable on the basis of the third fastening portion, and wherein the fourth connection portion is connected to the frame with the fourth fastening portion as a medium to be slidable on the basis of the fourth fastening portion.

* * * * *